US007398747B2

(12) United States Patent
Onodera et al.

(10) Patent No.: US 7,398,747 B2
(45) Date of Patent: Jul. 15, 2008

(54) ENGINE-DRIVEN WORK MACHINE

(75) Inventors: Taiyo Onodera, Saitama (JP); Kaku Okabe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/826,035

(22) Filed: Jul. 11, 2007

(65) Prior Publication Data

US 2008/0048510 A1 Feb. 28, 2008

(30) Foreign Application Priority Data

Aug. 25, 2006 (JP) ..... 2006-228911

(51) Int. Cl.
*F01P 1/06* (2006.01)

(52) U.S. Cl. ..... 123/41.65; 123/198 E; 290/1 A

(58) Field of Classification Search ..... 123/41.65, 123/41.56, 41.55, 41.7, 2, 198 E; 290/1 A
See application file for complete search history.

(56) References Cited

U.S. PATENT DOCUMENTS 5,174,406 A * 12/1992 Lee ..... 180/68.2
5,207,187 A * 5/1993 Kurohara et al. ..... 123/41.7
5,284,115 A * 2/1994 Imanishi et al. ..... 123/41.7
6,026,768 A * 2/2000 Spitler et al. ..... 123/41.58
6,502,659 B2 * 1/2003 Akasaka ..... 180/309
6,655,486 B2 * 12/2003 Oshikawa et al. ..... 180/68.1
2007/0108767 A1 * 5/2007 Hirose et al. ..... 290/1 A
2007/0176426 A1 * 8/2007 Hirose et al. ..... 290/1 A

FOREIGN PATENT DOCUMENTS

JP 2005-30353 2/2005

* cited by examiner

*Primary Examiner*—Stephen K. Cronin
*Assistant Examiner*—Hyder Ali
(74) *Attorney, Agent, or Firm*—Arent Fox LLP.

(57) ABSTRACT

A duct member is disposed around outer peripheries of an engine and an engine-driven generator to define a continuous cooling-air passage between the duct member and the outer peripheries. A cooling fan is disposed in the cooling-air passage to generate a flow of cool air from one end of the cooling-air passage to the other end during operation of the engine. An exhaust muffler of the engine is disposed in the vicinity of the other end of the cooling-air passage. An air guide plate is connected to the duct member and is suspended from an upper portion of the duct member to cover an upper portion of one side face of the exhaust muffler which is opposite the cooling-air passage so that the air guide plate guides the cooling air flowing out of the cooling-air passage downward along the one side face of the exhaust muffler.

4 Claims, 20 Drawing Sheets

ENGINE-DRIVEN WORK MACHINE

RELATED APPLICATION DATA

The present invention is based upon Japanese priority application No. 2006-228911, which is hereby incorporated in its entirety herein by reference.

BACKGROUND OF THE INVENTION

1. Field of the Invention

The present invention relates to an engine-driven work machine connected to and driven by an engine. The work machine includes a duct member disposed around outer peripheries of the engine and the work machine to define a continuous cooling-air passage between the duct member and the outer peripheries. A cooling fan is disposed in the cooling-air passage to generate cooling air flowing from one end of the cooling-air passage to the other end during operation of the engine. An exhaust muffler of the engine is disposed in the vicinity of the other end of the cooling-air passage, wherein the exhaust muffler is cooled by the cooling air flowing out of the cooling-air passage. The work machine driven by the engine encompasses a generator, an air compressor, a storage pump, and the like.

2. Description of the Related Art

Japanese Patent Application Laid-open No. 2005-30353 discloses an engine-driven work machine or generator.

An engine-driven generator is broadly used as a temporary power source in a construction site and other outdoor places. Therefore, it is often required to minimize the operational noise of the engine-driven generator in consideration of the environmental surroundings.

In the engine-driven generator disclosed in Japanese Patent Application Laid-open No. 2005-30353, a duct member is disposed around an outer periphery of the engine-driven work machine unit to define a continuous cooling-air passage between the duct member and the outer periphery. A cooling fan is mounted in the cooling-air passage to generate a flow of cooling air from one end of the cooling-air passage to the other end during operation of the engine. A muffler box is connected to the duct member with an inner space communicating with the other end of the cooling-air passage and has an air-discharge port in an upper end. An exhaust muffler of the engine is accommodated in the muffler box, thereby insulating the operational noise of the engine and the work machine and cooling the engine and the work machine as well as the exhaust muffler.

However, in the above-described engine-driven generator, heat from the engine and the exhaust muffler is liable to be confined within the duct member and the muffler box after stoppage of the operation of the engine, leading to a demand for facilitation of natural cooling of the engine and the exhaust muffler.

SUMMARY OF THE INVENTION

Accordingly, it is an aspect of the present invention to provide an engine-driven work machine, wherein natural cooling of an exhaust muffler and an engine is effectively performed even after operation of the engine has stopped.

In order to achieve the above aspect, according to a first feature of the present invention, there is provided an engine-driven work machine connected to and driven by an engine. The work machine includes a duct member disposed around outer peripheries of the engine and the work machine to define a continuous cooling-air passage between the duct member and the outer peripheries. A cooling fan is disposed in the cooling-air passage to generate a flow of cool air from one end of the cooling-air passage to the other end during operation of the engine. An exhaust muffler of the engine is disposed in the vicinity of the other end of the cooling-air passage, wherein the exhaust muffler is cooled by the cool air flowing out of the cooling-air passage. An air guide plate is connected to the duct member and is suspended from an upper portion of the duct member to cover an upper portion of one side face of the exhaust muffler which opposes the cooling-air passage. As such, the air guide plate guides the cool air flowing out of the cooling-air passage downward along the one side face of the exhaust muffler.

The work machine corresponds to a generator in an embodiment of the present invention which will be described later.

With the first feature of the present invention, when operation of the cooling fan is stopped following stoppage of operation of the engine, a convection flow is generated around the exhaust muffler due to a residual heat of the exhaust muffler. In this process, the ascending air flow is suppressed on the side of the exhaust muffler by the air guide plate covering the exhaust muffler and the duct member connecting the air guide plate, while the ascending air flow is generated on the other side face opposite the one side face. The ascending air flow attracts the air on the side of the air guide plate, so that the air in the cooling-air passage also flows around onto the other side face of the exhaust muffler to become the ascending air flow. The continuous process facilitates the natural cooling of the engine and the exhaust muffler.

According to a second feature of the present invention, in addition to the first feature, a muffler box is connected to the duct member to accommodate the exhaust muffler therein. An air-discharge port is provided in an upper portion of the muffler box to discharge the cool air which has been guided downward by the air guide plate to flow along the one side face of the exhaust muffler and then flow around to the other side face opposite the one side face of the exhaust muffler.

The air-discharge port corresponds to an air-discharge louver in the embodiment of the present invention which will be described later.

With the second feature of the present invention, the exhaust muffler is protected by the muffler box. Moreover, the natural cooling of the engine and the exhaust muffler is effectively facilitated even after operation of the engine has stopped by ascending the air flow toward the air-discharge port. The ascending air flow is smoothly generated from the residual heat of the exhaust muffler in a space between the other side face of the exhaust muffler and an inner wall of the muffler box opposite the other side face.

The exhaust muffler and the air guide plate serve as sound-insulating walls cooperatively isolating the cooling-air passage in the duct member and the air-discharge port in the muffler box from each other, thereby effectively preventing leakage of the noise generated by the operation of the engine and other components through the air-discharge louver. The above-described structural arrangement contributes to an improvement in the silencing performance of the engine-driven work machine.

According to a third feature of the present invention, in addition to the first or second feature, the exhaust muffler is disposed so that a lengthwise side face opposes an outlet of the cooling-air passage.

With the third feature of the present invention, the cooling air flowing out of the cooling-air passage is blown against a broader side face of the exhaust muffler to effectively cool the exhaust muffler.

The above and other aspects, features and advantages of the invention will become apparent from the following description of the preferred embodiment taken in conjunction with the accompanying drawings.

DESCRIPTION OF THE PREFERRED EMBODIMENTS

Figure 7:
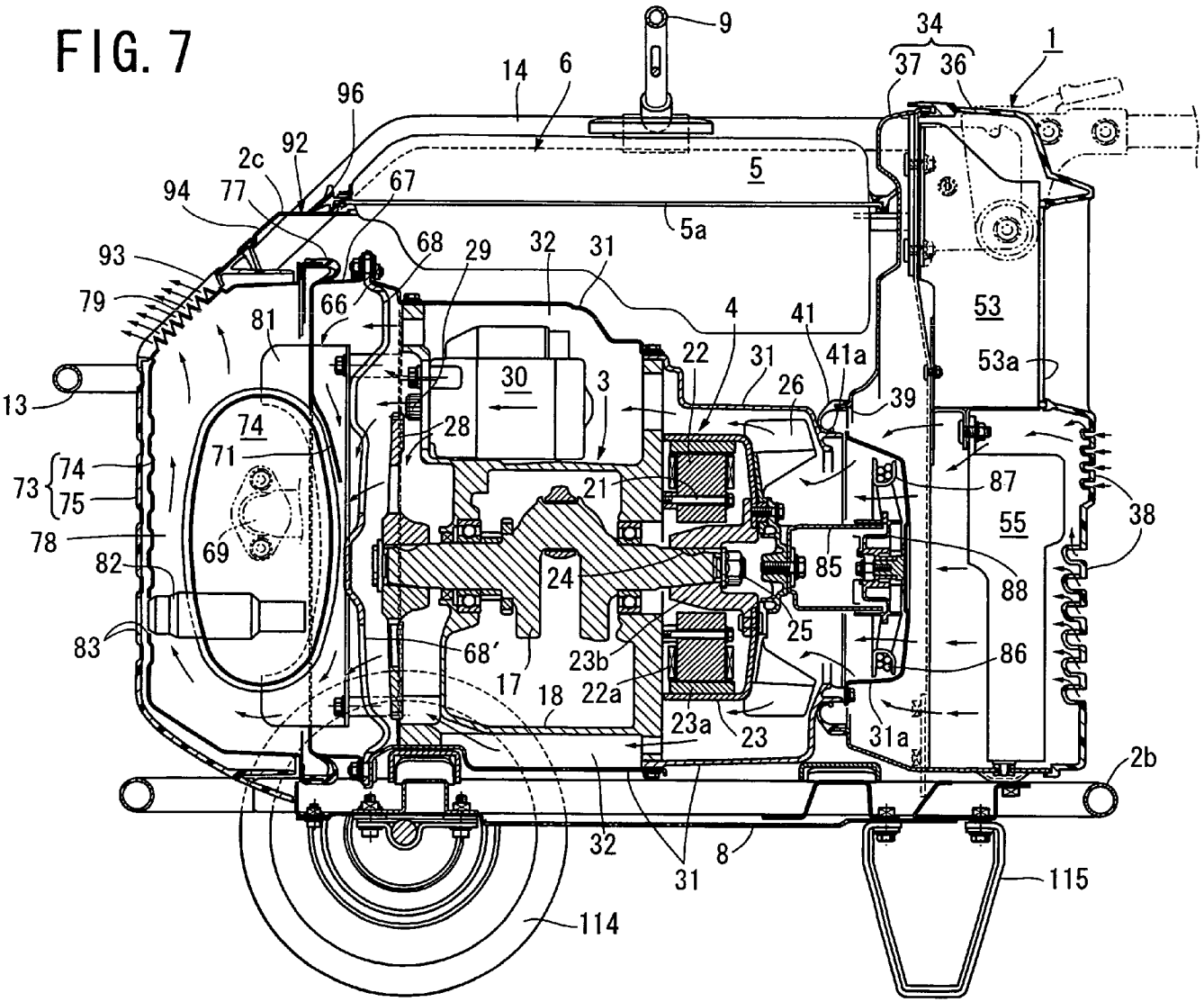
FIG. 7 is a cross-sectional view taken along line 7-7 in FIG. 5.

Referring to FIGS. 1 to 5 and 7, an engine-driven generator system 1 according to the present invention includes a frame 2, an engine 3 and a generator 4 (see FIG. 7). The engine 3 and the generator 4 are resiliently supported on a lower portion of the frame 2. A fuel tank 5 is mounted on an upper portion of the frame 2, along with a control unit 53 for the engine 3.

Figure 1:
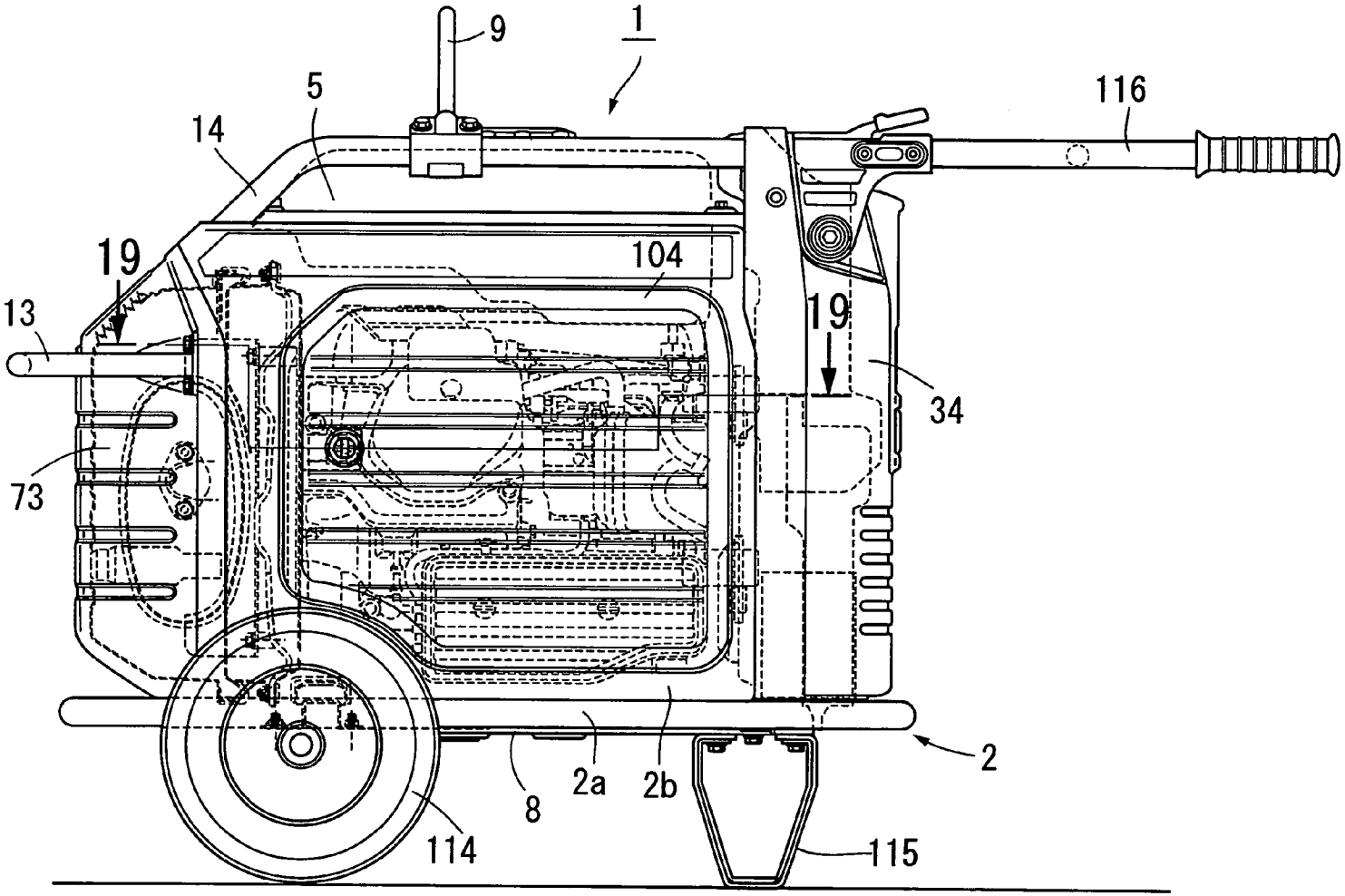
FIG. 1 is a side view of an engine-driven generator system according to a preferred embodiment of the present invention.
Figure 2:
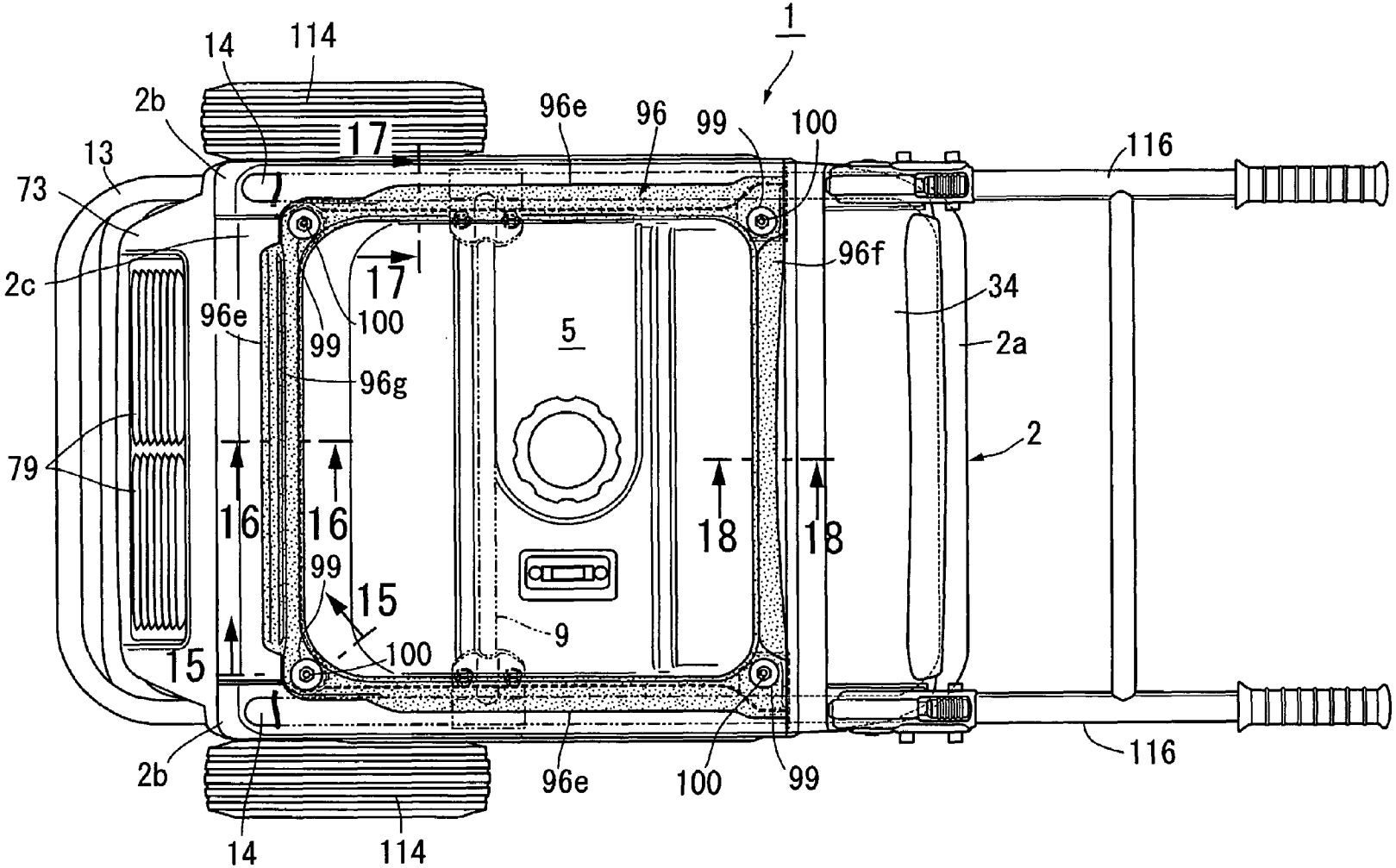
FIG. 2 is a plan view of the engine-driven generator system.
Figure 6:
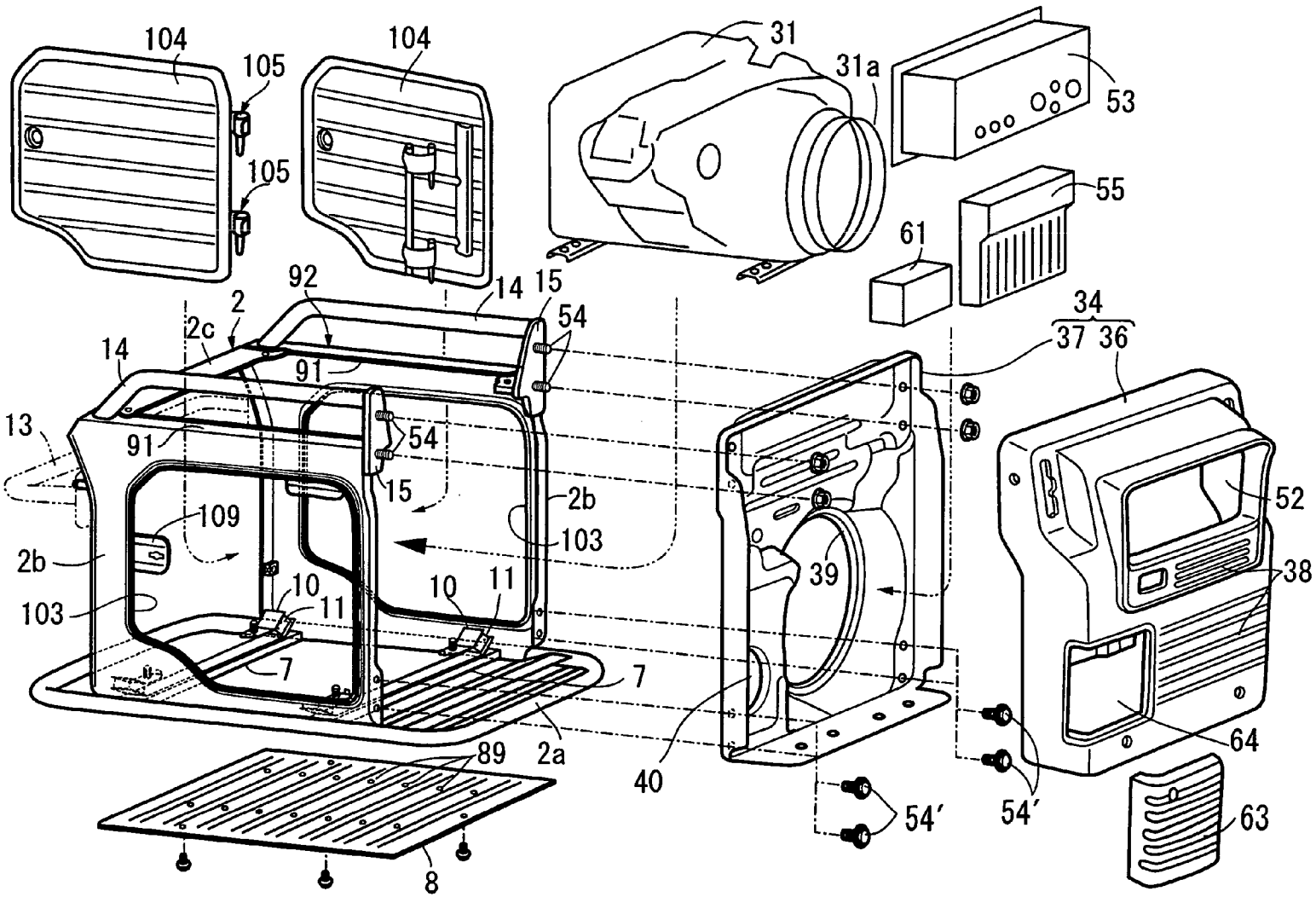
FIG. 6 is an exploded perspective view of a part of the engine-driven generator system.

As shown in FIGS. 1, 2 and 6, the frame 2 includes a frame bottom portion 2*a* formed by bending a steel pipe into a rectangular parallelepiped shape, left and right sidewall plates 2*b*, 2*b* welded to the left and right longer sides of the frame bottom portion 2*a*, respectively, so as to extend upward therefrom, and an upper cross member 2*c* which connects rear upper ends of the sidewall plates 2*b*, 2*b*. Each of the sidewall plates 2*b*, 2*b* is made of steel.

A bumper 13 is secured to rear intermediate portions of the left and right sidewall plates 2*b*, 2*b*, thereby connecting the rear intermediate portions to each other. The bumper 13 protrudes further from the rear of the frame 2 than the frame bottom portion 2*a*.

Reinforcing rods 14, 14 made of steel pipes are welded to upper ends of the left and right sidewall plates 2*b*, 2*b*, extend in the forward-rearward direction, and are disposed on opposing left and right sides of the fuel tank 5. The reinforcing rods 14, 14 are provided with a hanger member 9 which connects intermediate portions of the reinforcing rods 14, 14 to each other. The hanger member 9 is used for lifting the engine-driven generator system 1.

Figure 5:
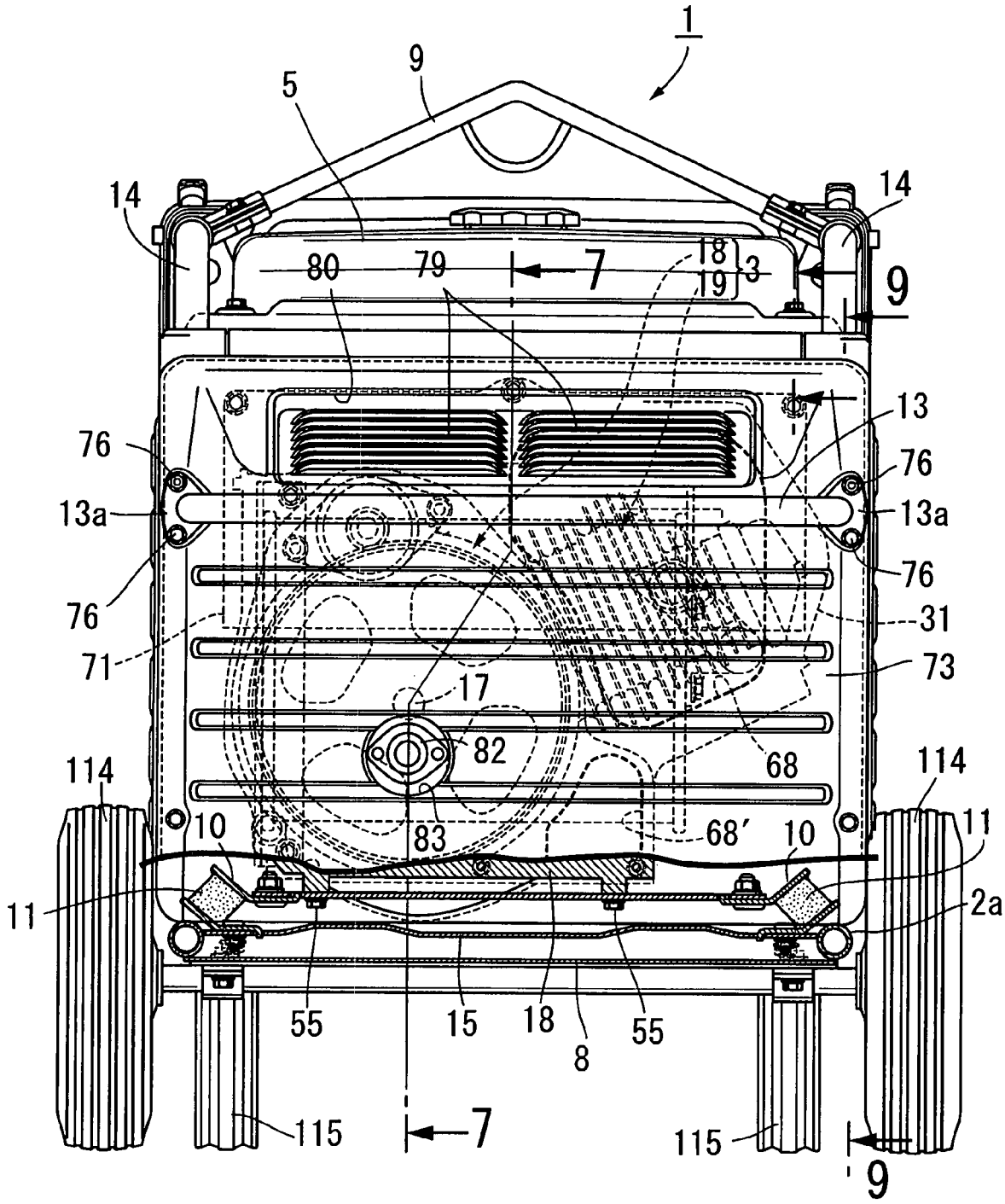
FIG. 5 is a partially cut-away rear view of the engine-driven generator system.

The frame bottom portion 2*a* is provided with a pair of front and rear cross-members 7, 7, which connect the left and right longer sides of the frame bottom portion 2*a*. As shown in FIGS. 5 and 6, front and rear sets of left and right support plates 10, 10 are mounted to the cross-members 7, 7 with elastic members 11, 11 interposed therebetween. Connecting plates 15, 15 are bolt-coupled to the support plates 10, 10 to connect the support plates 10, 10 to each other. A bottom wall of the engine 3 or a bottom wall of a later-described duct member 31 connected to the engine 3 is coupled to the connecting plates 15, 15 via bolts 33, 33. In the above-described manner, an assembly of the engine 3 and the generator 4 is resiliently supported on the frame 2.

A bottom plate 8 is screw-connected to the frame bottom portion 2*a* of the frame 2 and covers the frame bottom portion 2*a*. The fuel tank 5 is mounted on the left and right sidewall plates 2*b*, 2*b* and the upper cross-member 2*c*. A sound-insulating housing 6 is defined by the fuel tank 5, the left and right sidewall plates 2*b*, 2*b* and the bottom plate 8.

As shown in FIGS. 6 and 7, the duct member 31 is disposed within the sound-insulating housing 6 and surrounds the engine 3 and the generator 4. A continuous cooling-air passage 32 is defined between the duct member 31, the engine 3, and the generator 4. In order to facilitate manufacturing, the duct member 31 is divided into a plurality of sections which are bolt-coupled at appropriate positions to an outer peripheral surface of the engine 3.

Referring to FIG. 7, the engine 3 is a 4-cycle engine and is arranged with a crankshaft 17 extending in a forward-rearward direction of the engine-driven generator system 1. On one side, the engine 3 has a cylinder 19 protruding obliquely from a crankcase 18 which accommodates and supports the crankshaft 17.

As shown in FIG. 7, the generator 4 includes a stator 22 secured to a front end face of the crankcase 18 by a plurality of bolts 21. The stator 22 has a plurality of stator coils 22*a* and an outer rotor 23 which is secured to a front end of the crankshaft 17 and extends forward through a front end wall of the crankcase 18 and which has a plurality of permanent magnets 23*a* fixedly provided on an inner peripheral surface. That is, the generator 4 is an outer-rotor type multi-pole magnet generator. The outer rotor 23 includes a hub 23*b* surrounded by the stator 22. The hub 23*b* is fitted in a tapered manner over and secured to the end of the crankshaft 17 by a key 24 and nut 25. As a result of the above-described structural arrangement, the outer rotor 23 is supported on the crankshaft 17 in a cantilevered manner.

Mounted on an outer end face of the outer rotor 23 are a centrifugal cooling fan 26 having a diameter larger than that of the outer end face and corresponding to an inner diameter of the duct member 31, and a recoil starter 27 protruding forward of the cooling fan 26. The cooling fan 26 is disposed at one end of the cooling-air passage 32 so that the rotation of the cooling fan 26 generates cooling-air flowing from one end to the other end of the cooling-air passage 32.

A ring gear 28 is secured to a rear end of the crankshaft 17. A starter generator 30, which drives the ring gear 28 through a pinion 29, is mounted to an upper portion of the crankcase 18. The ring gear 28 has a plurality of ventilation bores for facilitating the cooling air to flow through the cooling-air passage 32.

Referring to FIGS. 1, 3-4 and 10-11, a rectangular parallelepiped intake box 34 is disposed at a front portion of the frame 2 and defines a profile of a front surface of the engine-driven generator system 1 when observed from a front view. The intake box 34 includes a synthetic resin box body 36 with an open rear surface and an end plate 37 coupled to the box body 36 to close the open rear surface of the box body 36. The end plate 37 is coupled by bolts 35 and 35' to the connecting plates 15, which connect the sidewall plate 2*b* and the front ends of the reinforcing rods 14 to each other, and to a lower portion of the sidewall plate 2*b*. The box body 36 is coupled to the end plate 37 by bolts 33.

Figure 11:
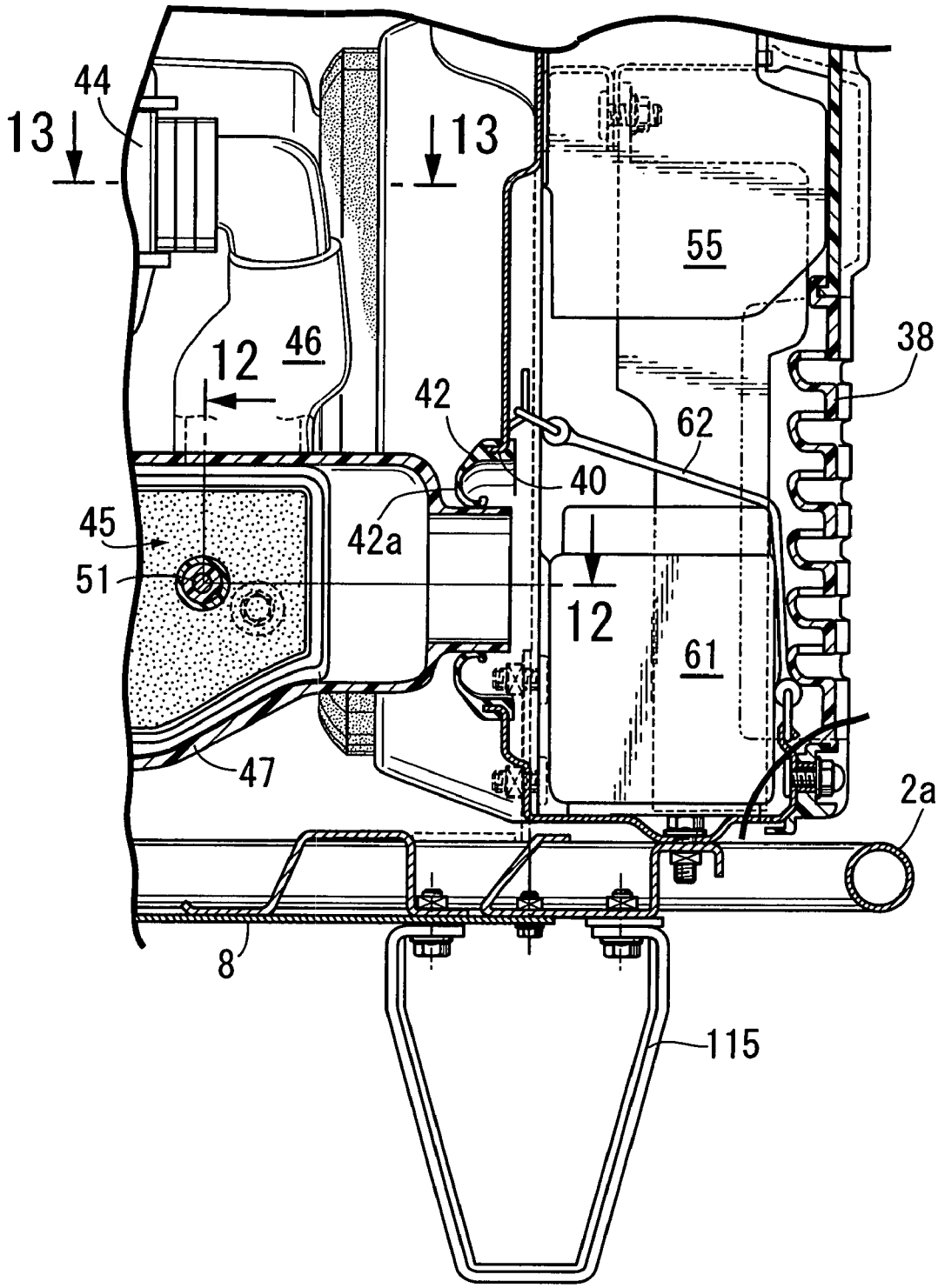
FIG. 11 is a cross-sectional view taken along line 11-11 in FIG. 3.

As shown in FIGS. 7 and 11, an air-intake louver 38 is formed in a front surface of the box body 36. The end plate 37 is provided with a first connection port 39 that has a large diameter and is adjacent to an upstream end 31*a* of the duct member 31 and a second connection port 40 having a small diameter. An annular first seal member 41, which is made from an elastic material, such as rubber, is mounted on a peripheral edge of the first connection port 39. The first seal member 41 has a highly-flexible annular seal lip 41*a* which is air-tightly fitted over an outer periphery of an upstream end 31*a* of the duct member 31. The first seal member 41 permits the duct member 31 and the intake box 34 to openly communicate with each other, while permitting for a relative displacement between the duct member 31 and the intake box 34 due to the resilient deformation of the seal lip 41*a* of the first seal member 41. The duct member 31 comprises, at an upstream end, a recoil starter cover 31*a* (which will be described later) protruding into the intake box 34. The recoil starter cover 31*a* is provided with a large number of ventilation bores. The intake box 34 has a cross-sectional area larger than the total opening area of the ventilation bores. The recoil starter cover 31*a* forms a silencing expansion chamber.

The recoil starter 27 includes a cup-shaped driven member 85 secured to the outer end face of the outer rotor 23, the bowl-shaped recoil starter cover 31*a* coupled to an upstream end of the duct member 31 to cover the recoil starter 27, a rope pulley 114, which is rotatably carried on an inner wall of the recoil starter cover 31*a* and around which a starter rope 86 is wound, and a one-way clutch 88 mounted between the rope pulley 114 and the driven member 85 and which links the rope pulley 114 and the driven member 85 to each other only when the rope pulley 114 is rotated in a normal rotational direction by pulling of the starter rope 86. The rope pulley 114 is urged in a reverse rotational direction by a return spring which is not shown. A large number of ventilation bores are formed in the rope pulley 114 so that the rope pulley does not impede the cooling air flow within the duct member 31.

Referring to FIGS. 10 to 13, a carburetor 44 is mounted to a front surface of the cylinder 19 of the engine 3. The carburetor 44 is disposed outside the duct member 31. An intake pipe 43 connecting the cylinder 19 and the carburetor 44 to each other extends through a through-bore 90 defined in a sidewall of the duct member 31. An air cleaner 45 is disposed outside the duct member 31 and is connected to an inlet of an intake passage in the carburetor 44 through a resilient communication tube 46 made of an elastic material, such as rubber. A plurality of ventilation bores 89 (see FIG. 6) are defined in the bottom plate 8 of the sound-insulating housing 6 and guide the cooling air flowing through the through-bore 90 to the outside. The ventilation bores 89 are formed at a size sufficiently smaller than the through-bore 90 so that the pressure within the sound-insulating housing 6 is maintained at a level equal to or higher than the atmospheric pressure despite the air flowing out through the ventilation bores 89.

Figure 10:
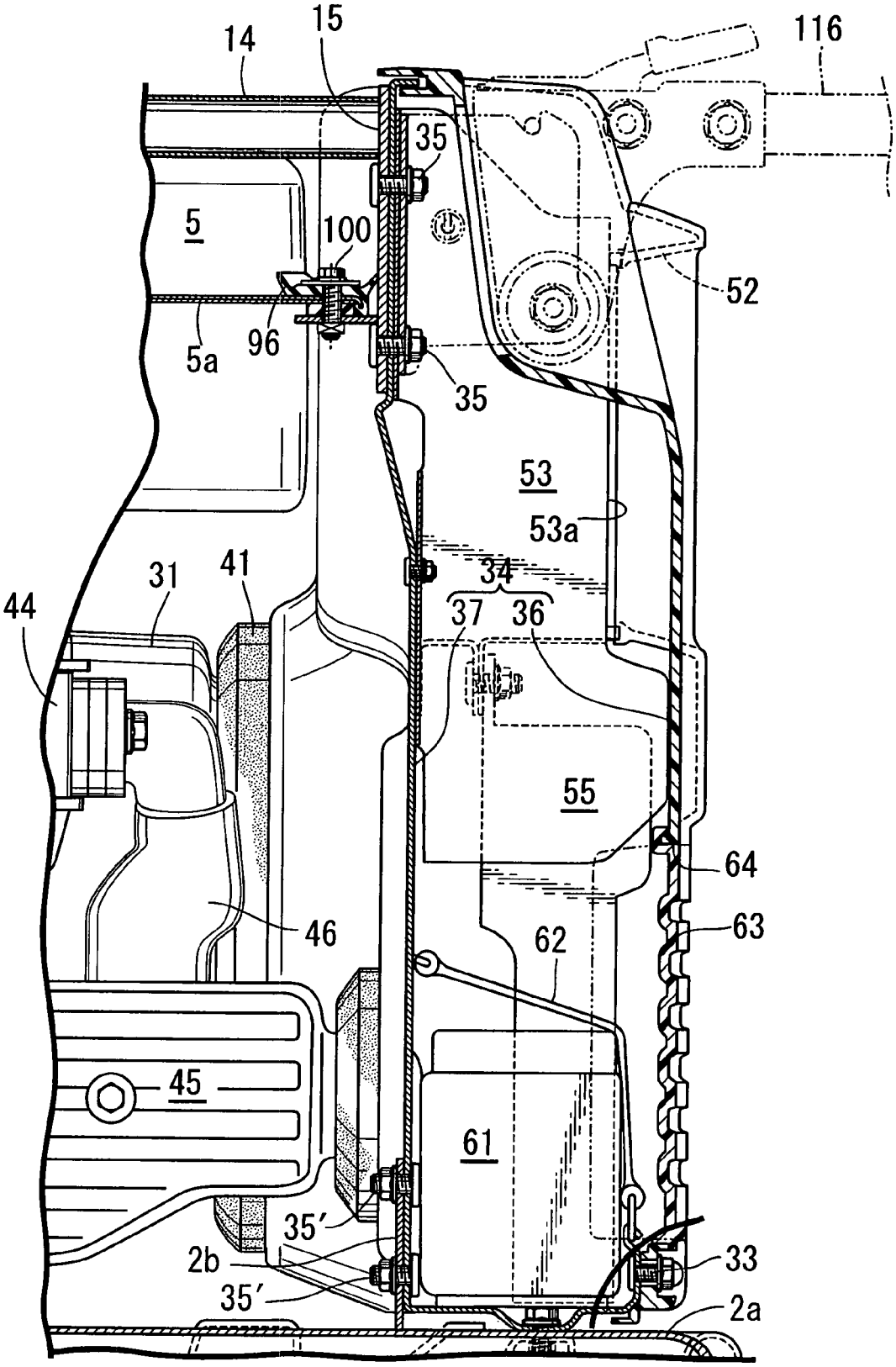
FIG. 10 is a cross-sectional view taken along line 10-10 in FIG. 3.

As shown in FIGS. 1 and 10, the air cleaner 45 has a substantially rectangular shape that is longer in an axial direction of the crankshaft 17 of the engine 3 when observed in a side view and is disposed so that at least a portion thereof is located below the cylinder 19 which is inclined slightly upward in one sideway direction of the crankcase 18. With the above-described structural arrangement, the air cleaner 45, having a relatively large capacity, can be used, while lowering the center of gravity of the engine-driven generator system 1.

Figure 12:
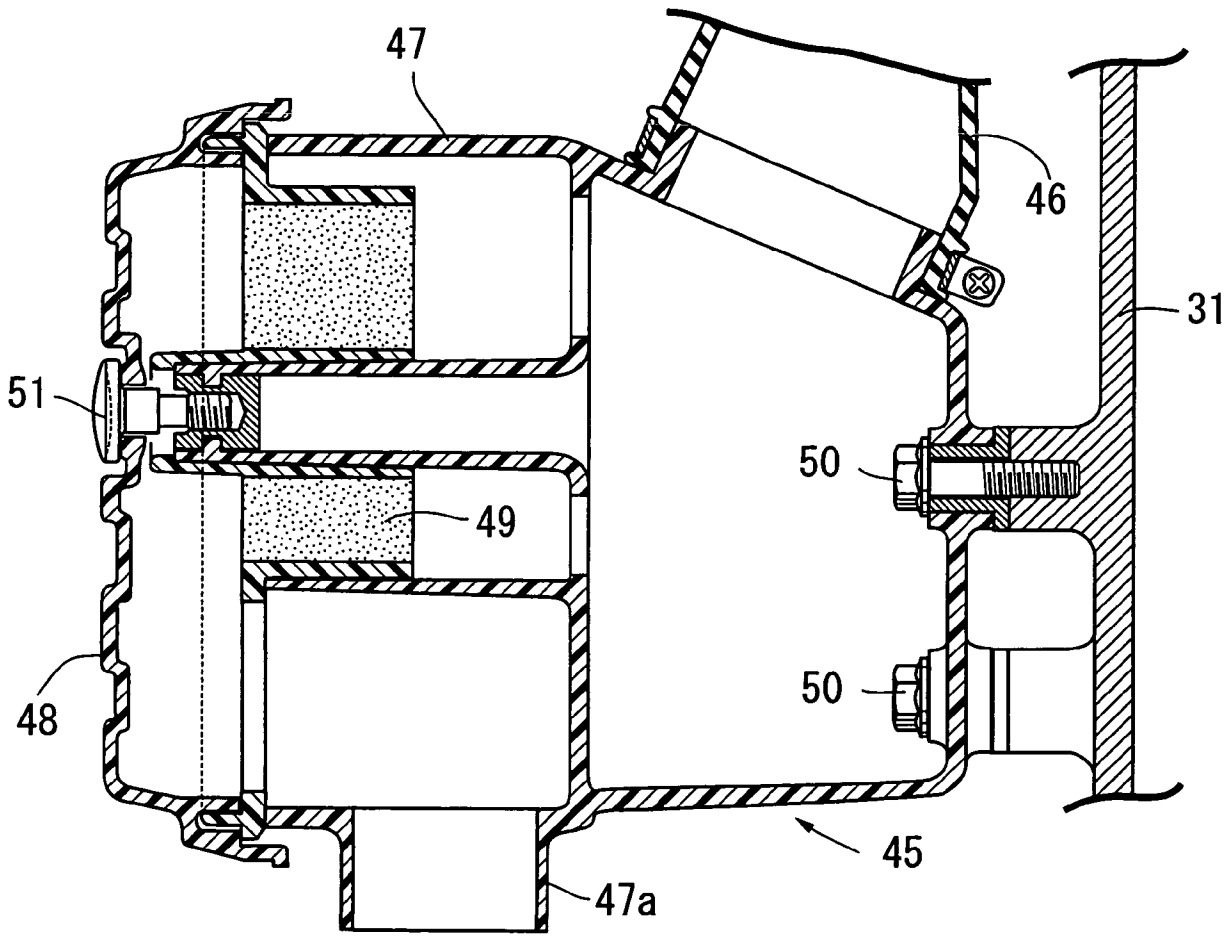
FIG. 12 is a cross-sectional view taken along line 12-12 in FIG. 11.
Figure 13:
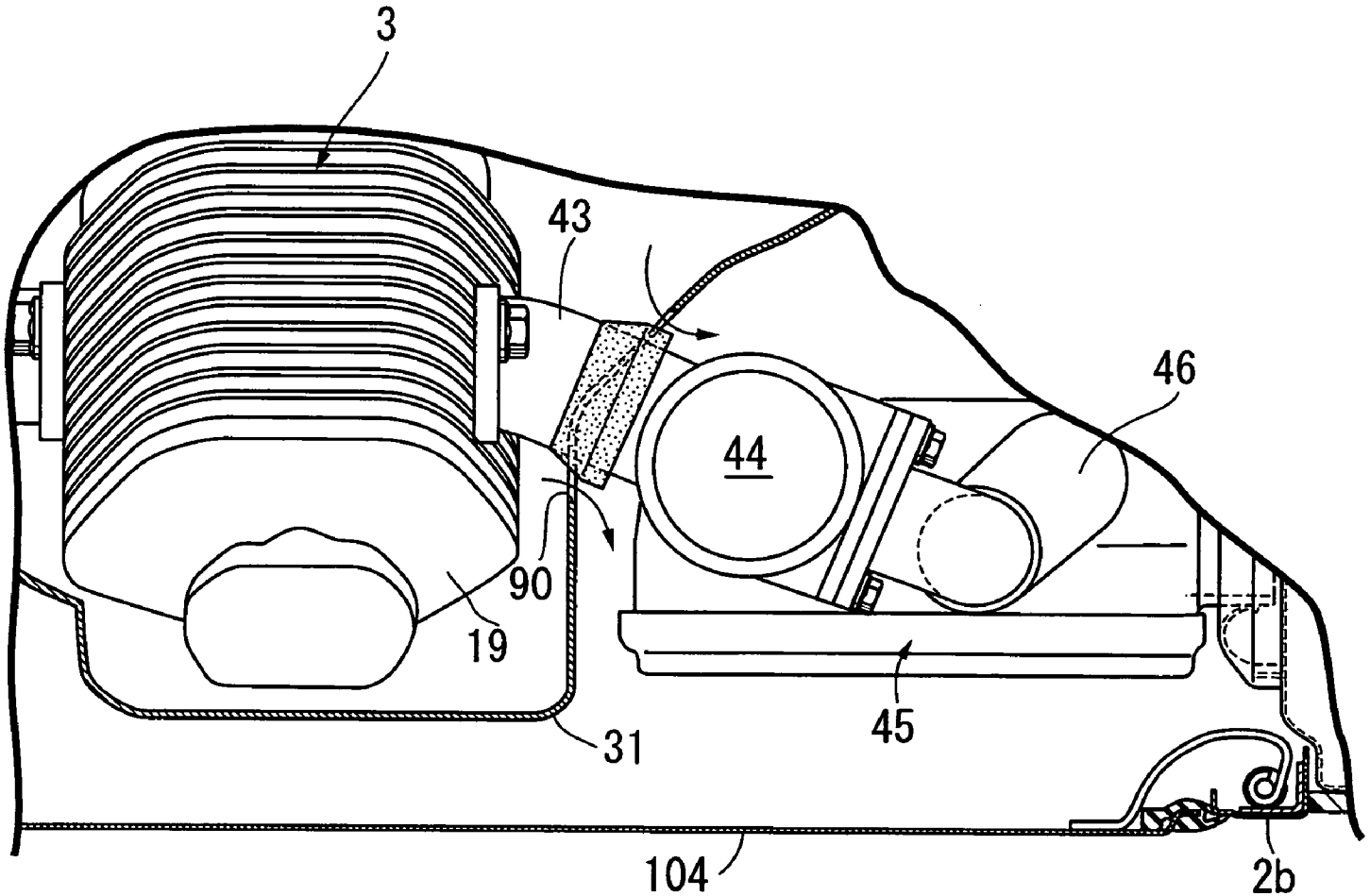
FIG. 13 is a cross-sectional view taken along line 13-13 in FIG. 11.
Figure 14:
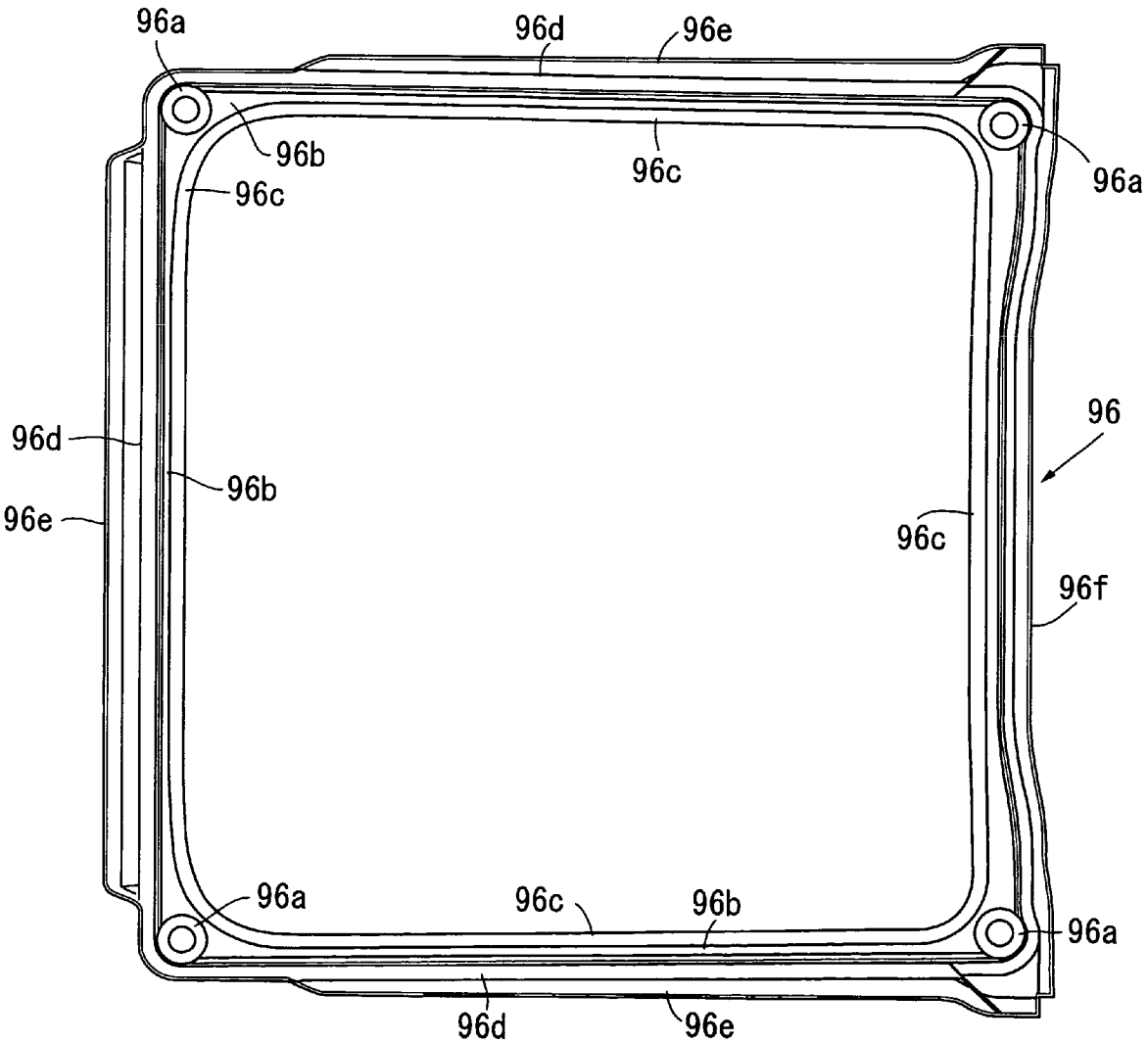
FIG. 14 is a bottom view of a seal member of a fuel-tank mounting portion.
Figure 15:
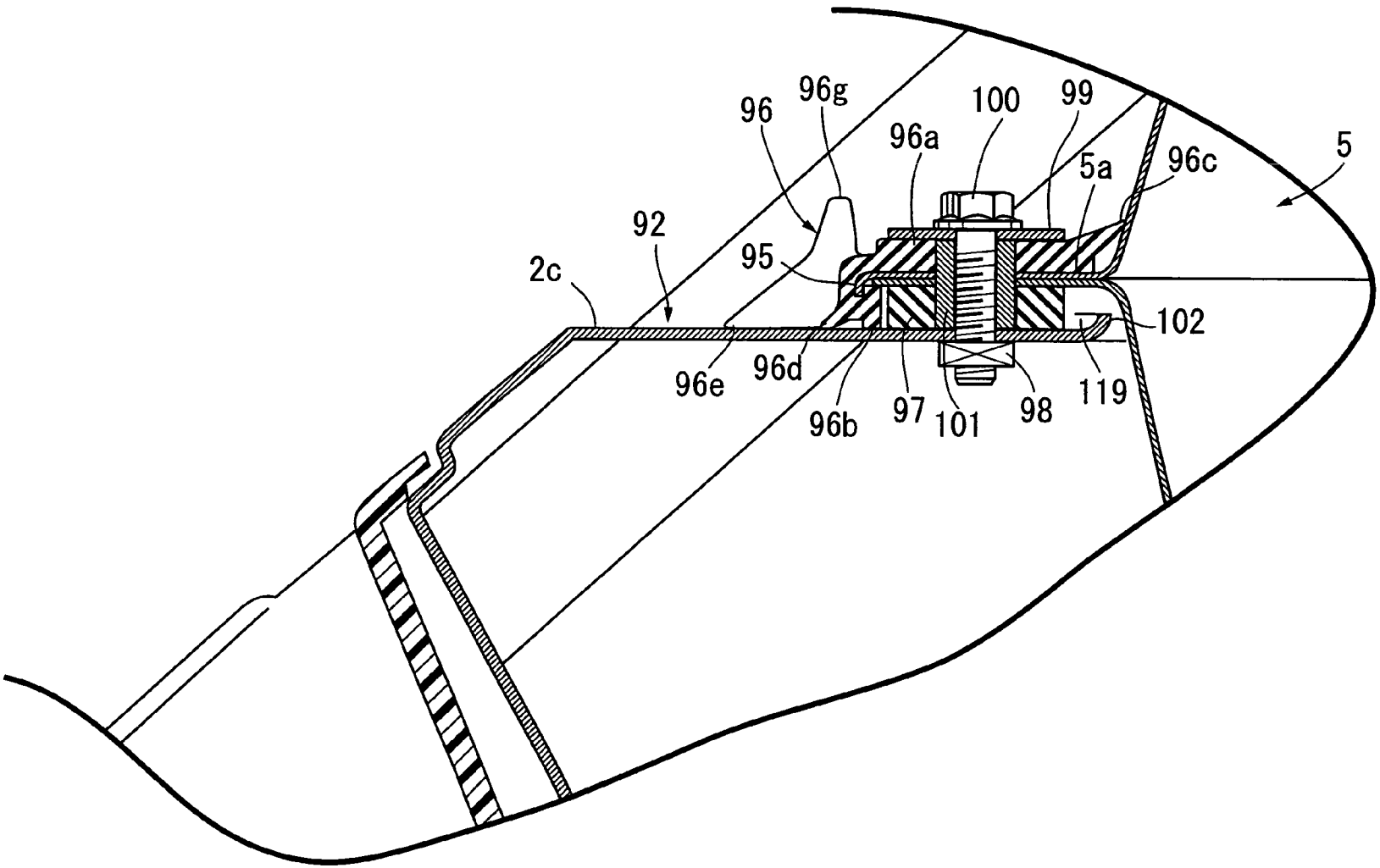
FIG. 15 is an enlarged cross-sectional view taken along line 15-15 in FIG. 2.
Figure 16:
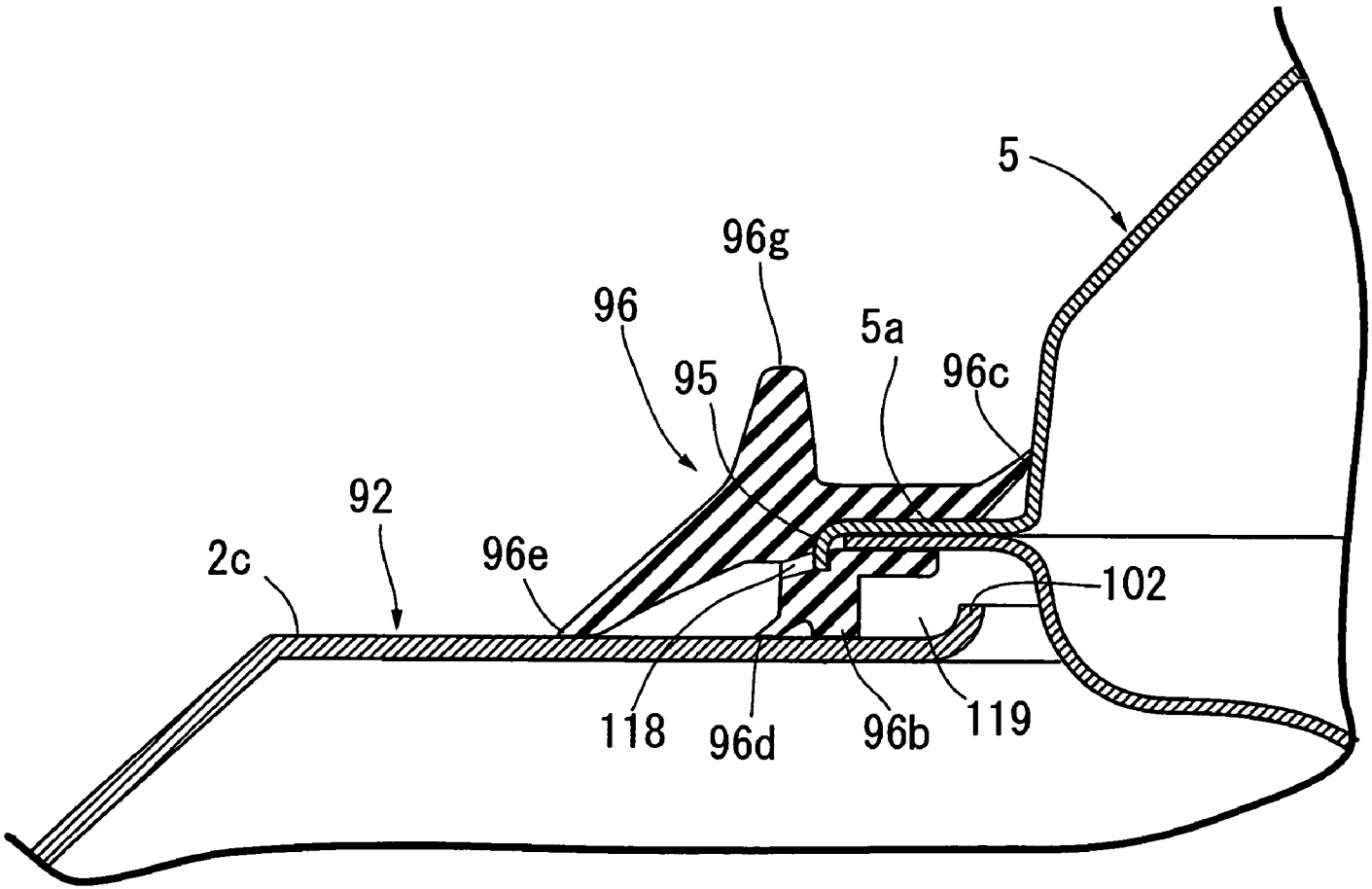
FIG. 16 is an enlarged cross-sectional view taken along line 16-16 in FIG. 2.
Figure 17:
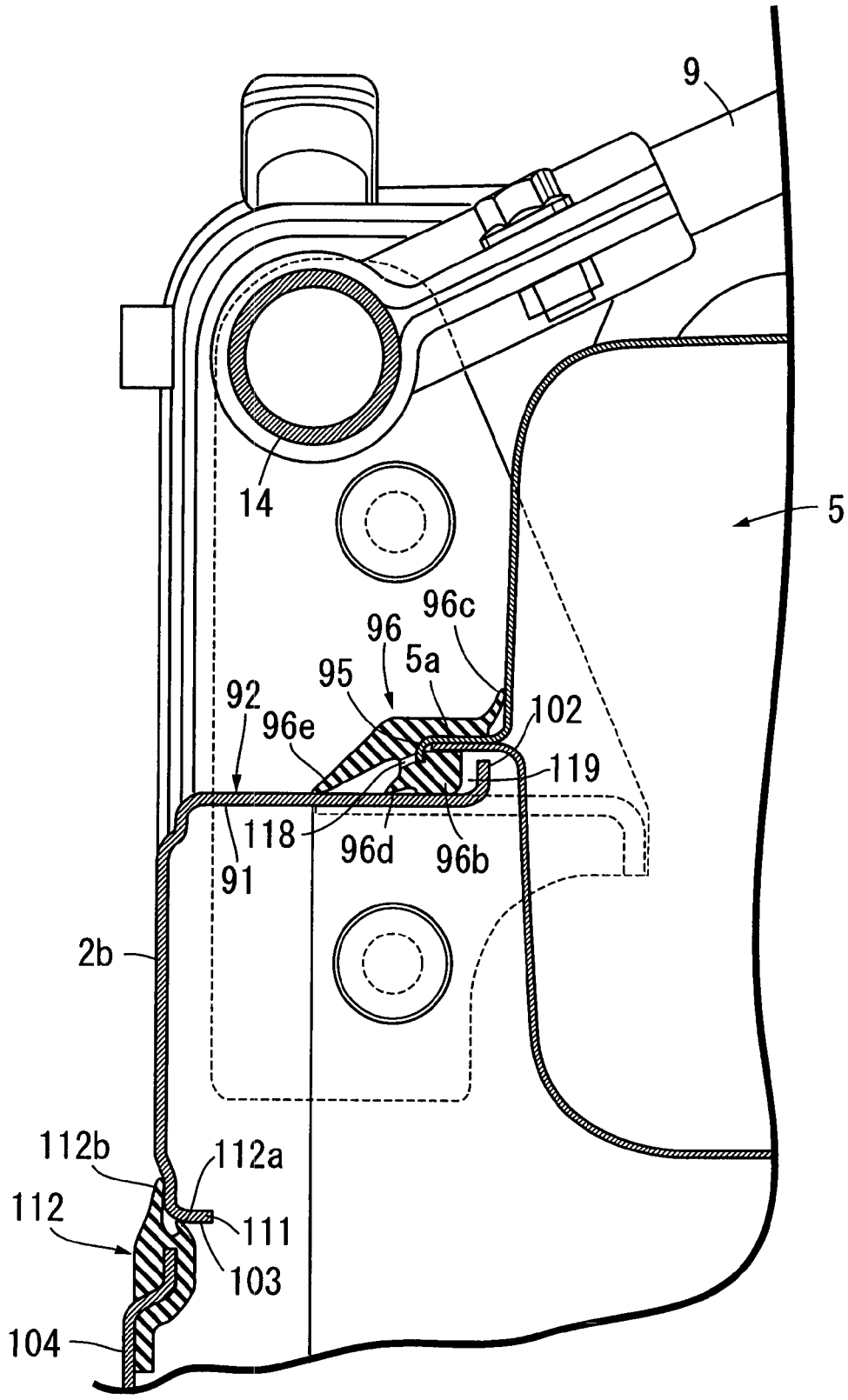
FIG. 17 is an enlarged cross-sectional view taken along line 17-17 in FIG. 2.
Figure 18:
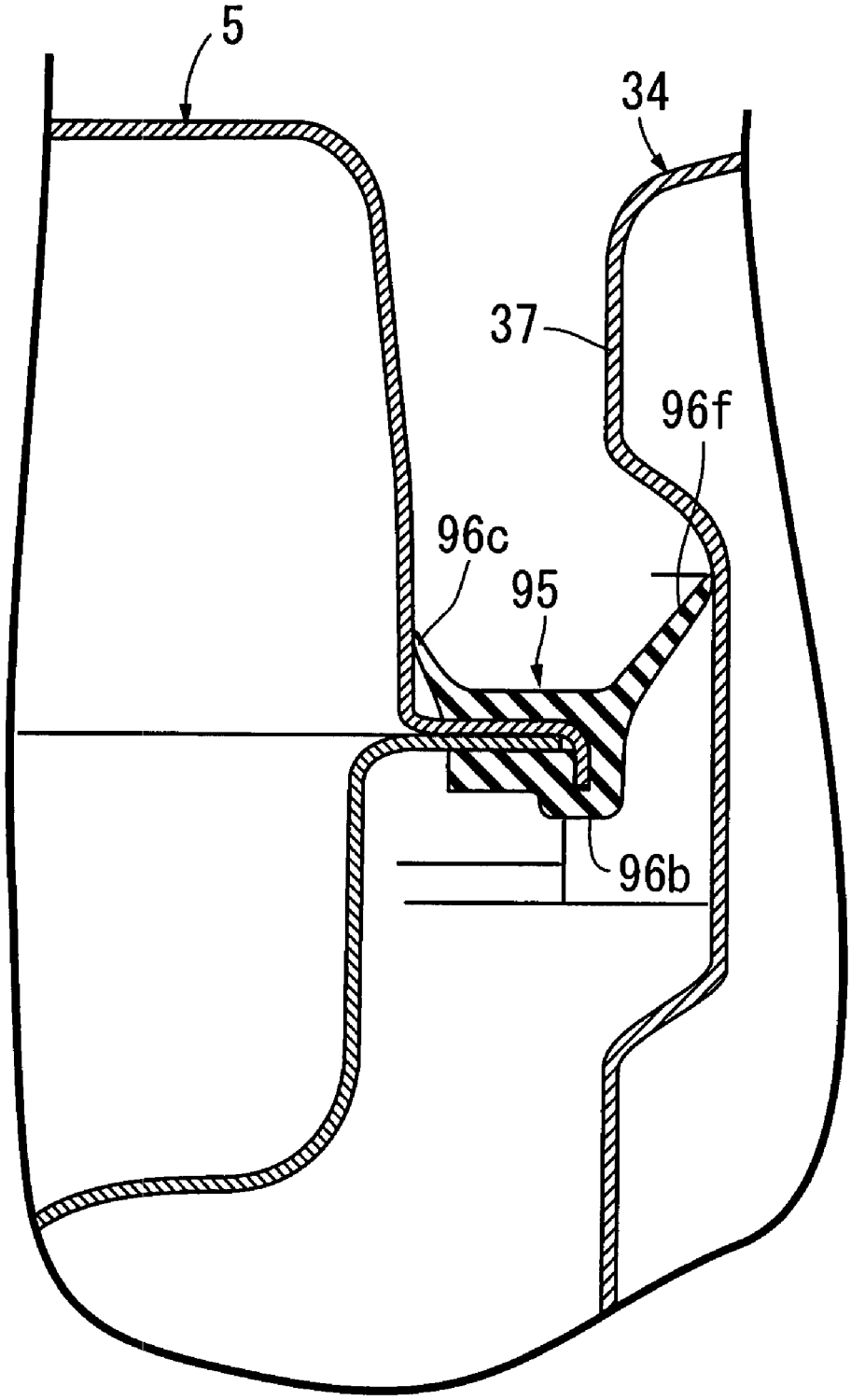
FIG. 18 is an enlarged cross-sectional view taken along line 18-18 in FIG. 2.

As clearly shown in FIGS. 10 to 12, the air cleaner 45 includes a cleaner case 47 secured by a bolt 50 to the duct member 31 with an open outer surface, a case cover 48 coupled by a bolt 51 to the cleaner case 47 to close the open outer surface of the cleaner case 47, and a cleaner element 49 clamped between the cleaner case 47 and the case cover 48. The cleaner case 47 integrally includes an air inlet pipe 47*a* communicating with an uncleaned surface of the cleaner element 49.

A second annular seal member 42 made of an elastic material, such as rubber, is mounted to a peripheral edge of the second connection port 40. The second annular seal member 42 has a highly-flexible lip 42*a*, which is fitted over an outer periphery of the air inlet pipe 47*a* of the air cleaner 45. The second seal member 42 provides communication between the duct member 31 and the intake box 34, while permitting the relative displacement between the duct member 31, which is resiliently supported on the frame 2 through the engine 3, and the intake box 34, which is fixedly supported on the frame 2 by the resilient deformation of the seal lip 42*a* of the first seal member 42.

Figure 3:
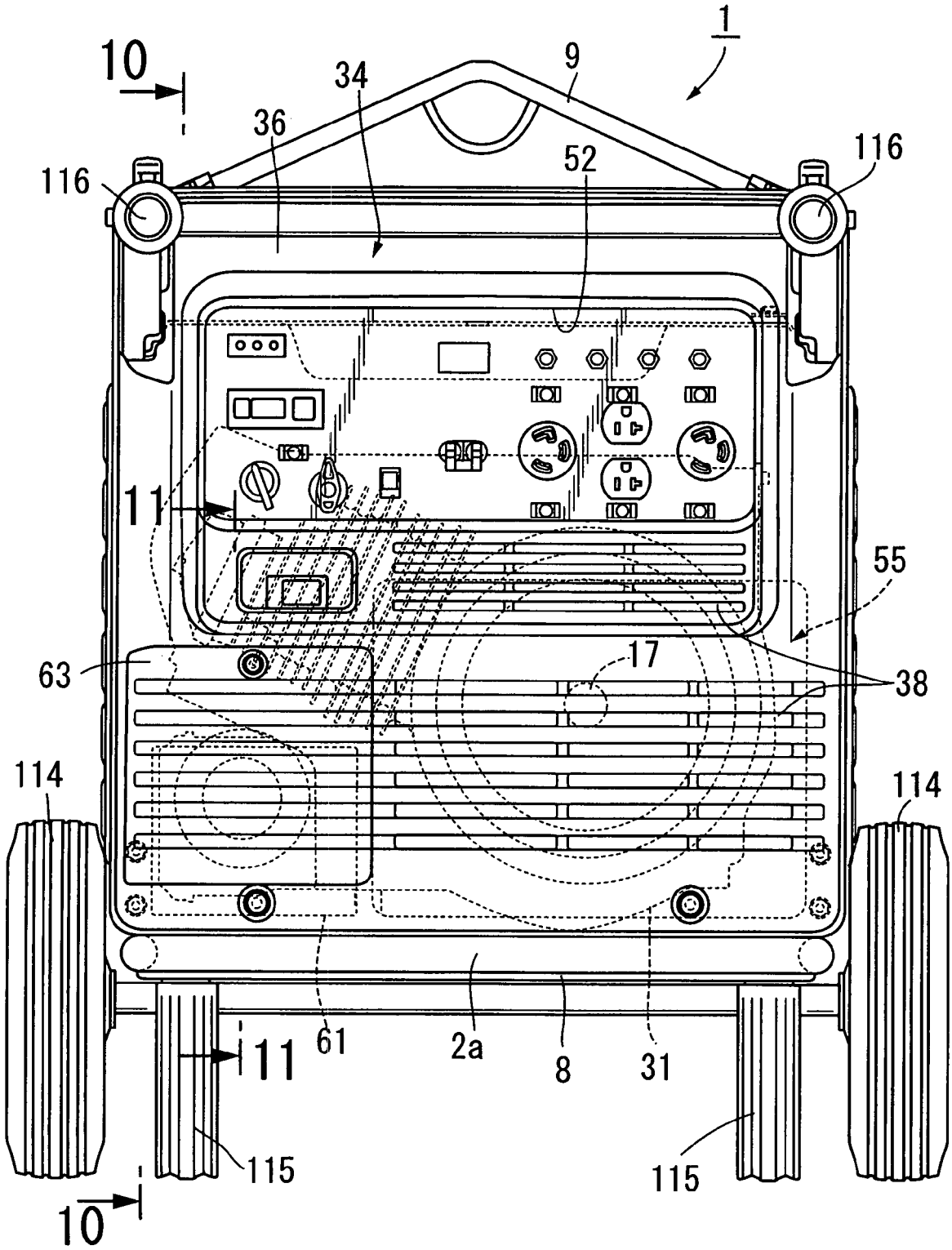
FIG. 3 is a front view of the engine-driven generator system.
Figure 4:
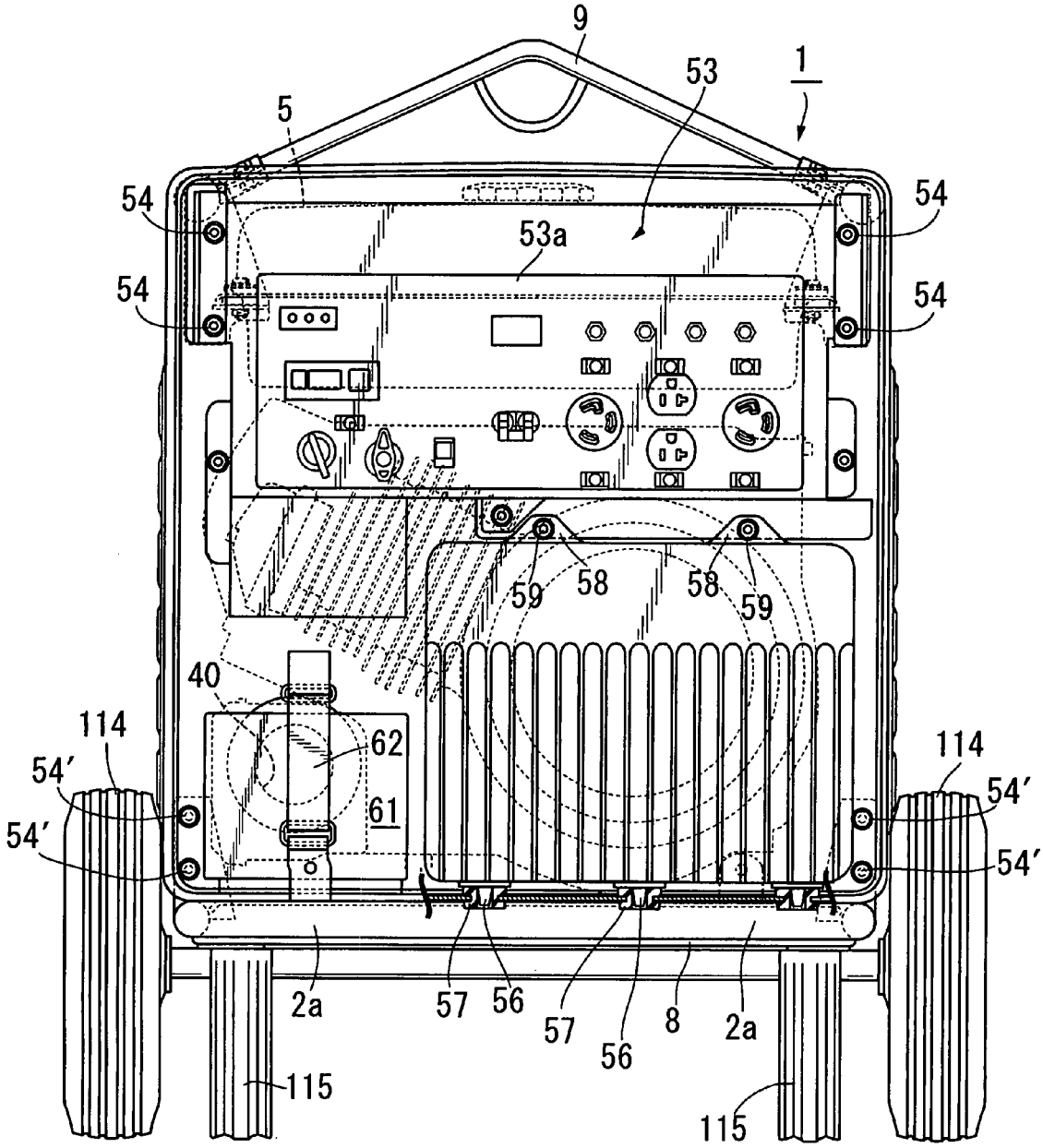
FIG. 4 is a front view of the engine-driven generator system showing a state in which a body of an intake box is removed.

Referring to FIGS. 3 and 10, the intake box 34 has an operating window 52 provided in an upper portion of a front surface. The control unit 53 for the engine 3 and the generator 4 is disposed above the first connection port 39 within the intake box 34 and has an operating panel 53*a* facing the operating window 52. The operating panel 53*a* is secured by a bolt 54 to an inner surface of a rear wall of the intake box 34.

Within the intake box 34, the control unit 53 and an inverter 55 are disposed between the air-intake louver 38 and the first connection port 39. A battery 61 is disposed between the air-intake louver 38 and the second connection port 40. Particularly, the upstream end, i.e., the recoil starter cover 31*a* of the duct member 31 protruding out of the first connection bore 39 into the intake box 34, is disposed in the vicinity of a rear face of the inverter 55.

The inverter 55 is mounted to the intake box 34 by supporting a plurality of support shafts 56 (see FIG. 4) projectingly provided on a lower end face of the inverter 55 on the bottom wall of the intake box 34 with a grommet 57 interposed therebetween and by coupling a plurality of ear pieces 58 at an upper end of the inverter 55 to the end plate 37 of the intake box 34 with bolts 59. In this case, a ventilation gap is provided around the periphery of the inverter 55.

The battery 61 is retained on the end plate 37 by a rubber band 62. In this case, a ventilation gap is provided around the periphery of the battery 61 so as not to impede the air flowing from the air-intake louver 38 to the second connection port 40. For inspection of the battery 61, an inspection window 64 capable of being closed by a lid 63 is provided in a front wall of the intake box 34.

Figure 8:
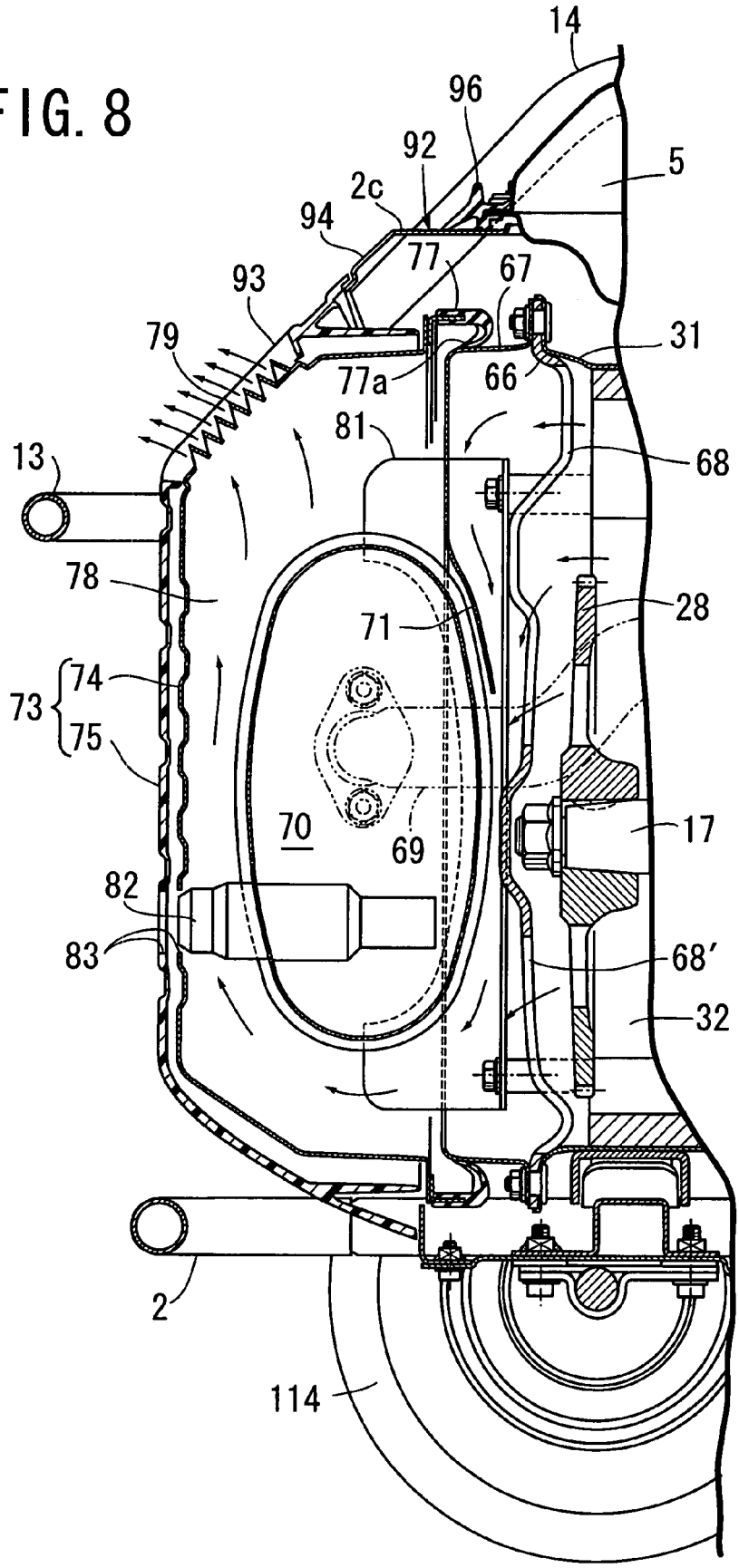
FIG. 8 is an enlarged view of a region near an exhaust muffler.

Referring to FIGS. 7 and 8, a ventilation restricting plate 66 and a seal tube 67, which is disposed outside the ventilation restricting plate 66, are bolt-coupled in a superposed manner to a downstream end of the duct member 31. Large and small ventilation bores 68 and 68', which serve as outlets of the cooling-air passage 32, are vertically provided in the ventilation restricting plate 66 wherein the bores 68 and 68' are open and face the cylinder 19 of the engine 3. An exhaust muffler 70 is disposed outside the seal tube 67 and connected to an exhaust pipe 69 extending from the engine 3. The exhaust muffler 70 is tubular having an elliptic sectional shape with a vertical axis that is longer than a horizontal axis and which corresponds to the centerline of the muffler 70. The exhaust muffler 70 is supported on the engine 3 through a stay 81 protruding from an outer surface of the exhaust muffler 70. With the above-described structural arrangement, the lengthwise dimension of the engine-driven generator system 1 is reduced, and a broader side face of the exhaust muffler 70 opposes the outlet of the cooling-air passage 32. Thus, the cooling air flowing out of the cooling-air passage 32 is blown against the broader side face of the exhaust muffler 70 and effectively cools the muffler 70.

An air guide plate 71 is integrally connected to and suspended from an upper end of the seal tube 67 such that the air guide plate 71 covers an upper portion of a side face of the exhaust muffler 70 facing the ventilation restricting plate 66. Particularly, the air guide plate 71 opposes the large ventilation bore 68 and guides the cooling air flowing out of the ventilation bore 68 to a space below the exhaust muffler 70.

Figure 9:
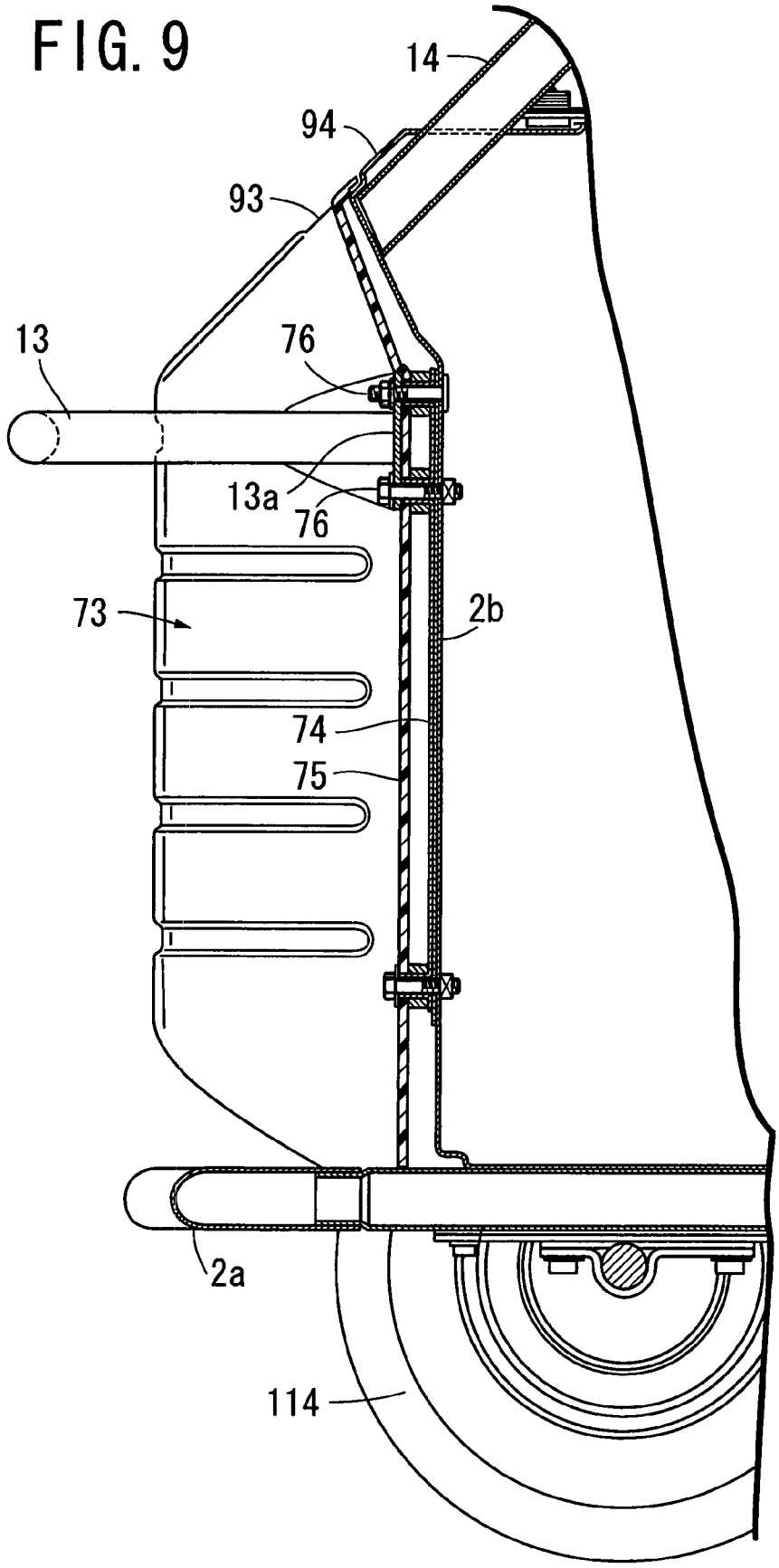
FIG. 9 is a cross-sectional view taken along line 9-9 in FIG. 5.

On the other hand, a muffler box 73, which accommodates the exhaust muffler 70, is mounted to the rear end of the frame 2. The muffler box 73 includes a box body 74 made of a steel plate and a box cover 75 made of a synthetic resin and which covers an outer surface of the box body 74. The box body 74 and the box cover 75 are secured to the rear end of the frame 2 by bolts 76 (see FIGS. 5, 9 and 19) together with connecting flanges 13*a*, 13*a* formed at opposite ends of the bumper 13.

An annular seal member 77 is mounted at an inner end of the box body 74 wherein a seal lip 77*a* of the seal member 77 comes into close contact with the seal tube 67.

The box body 74 defines a ventilation gap 78 between the box body 74 and an outer surface of the exhaust muffler 70. An air-discharge louver 79 is formed at an upper portion of the box body 74 and leads to the ventilation gap 78. The box cover 75 is provided with an opening 80 which faces the air-discharge louver 79. An inclined rear corner portion 93 disposed at the upper portion of the muffler box 73 faces rearward and inclines downward. The air-discharge louver 79 and the opening 80 are disposed at the inclined portion 93. A small opening 83 is defined in rear walls of the box body 74 and the box cover 75 such that an exhaust outlet pipe 82 protruding from the rear surface of the exhaust muffler 70 faces the small opening 83.

The box body 74 has a cross-sectional area larger than an opening area of the air-exhausting bores 68 and 68' in the ventilation restricting plate 66, and also functions as a silencing expansion chamber.

The mounting structure of the fuel tank 5 will be described below with reference to FIGS. 2, 6 and 14 to 18.

Flat portions 91, 91 bending horizontally inward are formed at upper ends of the left and right sidewall plates 2*b*, 2*b* of the frame 2. The upper cross member 2*c* is disposed to interconnect rear ends of the flat portions 91, 91 in a flush manner. Thus, the flat portions 91, 91 and the upper cross member 2*c* constitute a flat tank-supporting portion 92 having a U-shape in a plan view. A rear half 94 of the upper cross member 2*c* is formed as an inclined portion 94 leading to an upper end of the inclined portion 93 of the muffler box 73, so that any rainwater which falls onto upper surfaces of the inclined portions 93 and 94 is immediately allowed to flow down the inclined portions 93 and 94.

The fuel tank 5 is mounted to the tank-supporting portion 92 in the following manner.

The fuel tank 5 has a rectangular shape in a plan view, and includes a mounting flange 5*a* formed around an outer periphery of the fuel tank 5. The mounting flange 5*a* includes a downward-bending, downward-oriented collar 95 around an outer periphery of the mounting flange 5*a*. A rectangular seal member 96 is mounted to the mounting flange 5*a* and encloses the downward-facing collar 95.

The seal member 96 is integrally provided with boss portions 96*a* (see FIG. 15) disposed at four corners of the mounting flange 5*a*. A seat plate 99 is superposed onto the boss portions 96*a*. The mounting flange 5*a* is superposed on the tank-supporting portion 92 with resilient members 97 which are interposed therebetween and disposed at locations corresponding to the boss portions 96*a*. Welding nuts 98 are provided on a lower surface of the tank-supporting portion 92 at the locations corresponding to the boss portions 96*a*. The mounting flange 5*a* is resiliently supported on the tank-supporting portion 92 by threadedly tightening bolts 100 passing through the seat plate 99, the mounting flange 5*a* and the resilient members 97 into the welding nuts 98. In this arrangement, a separation collar 101 is fitted over an outer periphery of each bolt 100 in order to restrict the deformation of the boss portions 96*a* and the resilient members 97.

Integrally formed in the inner periphery of the seal member 96 are a seat portion 96*b* supported on an upper surface of the tank-supporting portion 92 and an inner seal lip 96*c* in close contact with an outer peripheral surface of the fuel tank 5 above the mounting flange 5*a*. The inner seal lip 96*c* has an outer side face inclining upward toward the fuel tank 5.

Integrally formed in the outer periphery of the seal member 96 are a first endless outer seal lip 96*d* in close contact with the upper surface of the tank-supporting portion 92 at left and right sides and a rear side (i.e., at portions around the exhaust muffler 70) of the outer periphery and second outer seal lips 96*e* likewise in close contact with the upper surface of the tank-supporting portion 92 outside the first outer seal lip 96*d*. The second outer seal lip 96*e* has an outer surface inclining outward and downward.

In the illustrated example, the second outer seal lips 96*e* terminate in the vicinity of the rear boss portions 96*a* and are integrally connected to the first outer seal lip 96*d*. The above-described structural arrangement prevents the second outer seal lips 96*e* from interfering with the reinforcing rod 14 rising from the rear end of the tank-supporting portion 92. When there is no possibility of such interference, it is preferable that the second outer seal lips 96*e* also be provided around the rear boss portions 96*a*.

A third seal lip 96*f* is integrally formed on the front edge portion of the seal member 96 so as to come into close contact with a rear surface of the intake box 34.

Further, a weir 96*g* is integrally formed at a portion of the seal member 96 located on the side of the muffler box 73 such that the weir 96*g* rises from a top portion of a slope of the second outer seal lip 96*e* and extends in the left/right direction. The weir 96*g* serves to prevent any fuel that may have leaked from a fuel supply opening from flowing toward the muffler box 73.

Furthermore, drain holes 118 are provided at various positions in the seal member 96 so that the lower end of the downward-facing collar 95 of the mounting flange 5*a* communicates with the outside of the first outer seal lip 96*d*.

Provided in the inner peripheral edge of the tank-supporting portion 92 is an upward-facing collar 102 rising from the inner side of the seal member 96 toward the mounting flange 5*a*. A gap 119 is provided between the upward-facing collar 102 and the seal member 96.

Figure 19:
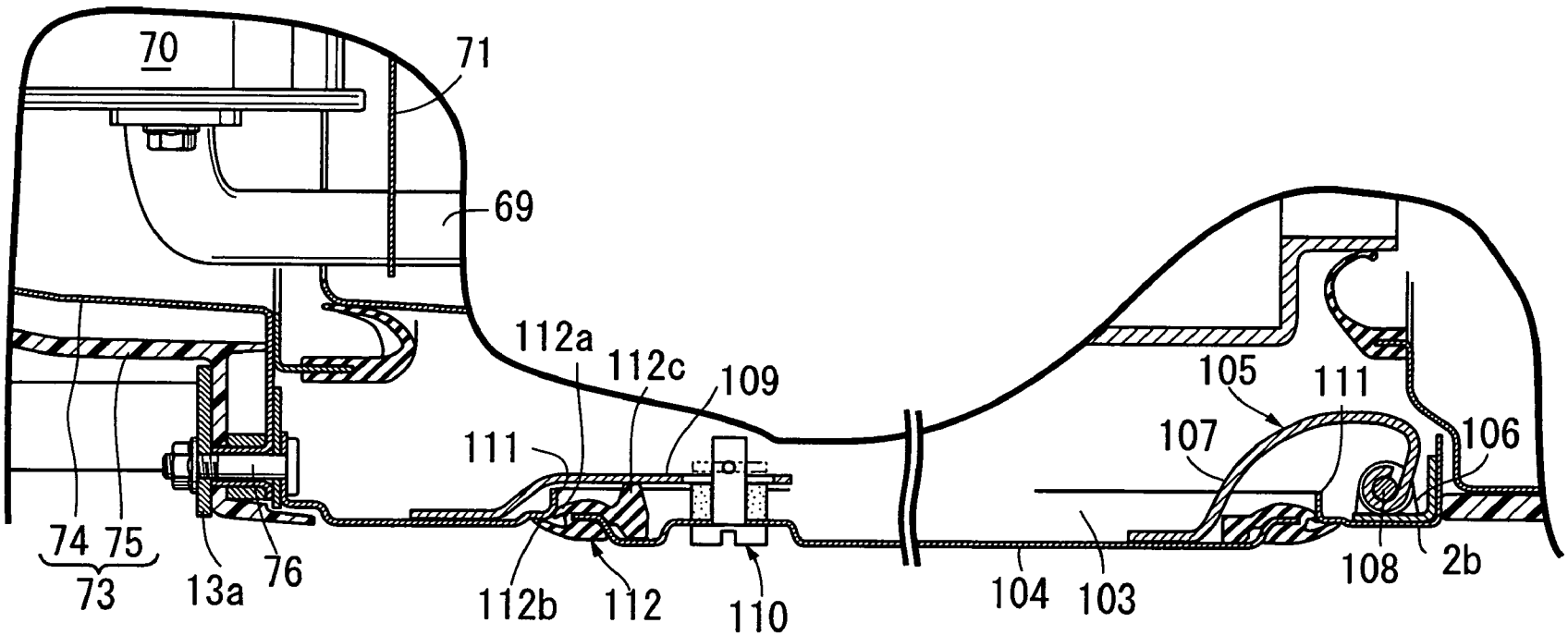
FIG. 19 is an enlarged cross-sectional view taken along line 19-19 in FIG. 1.
Figure 20:
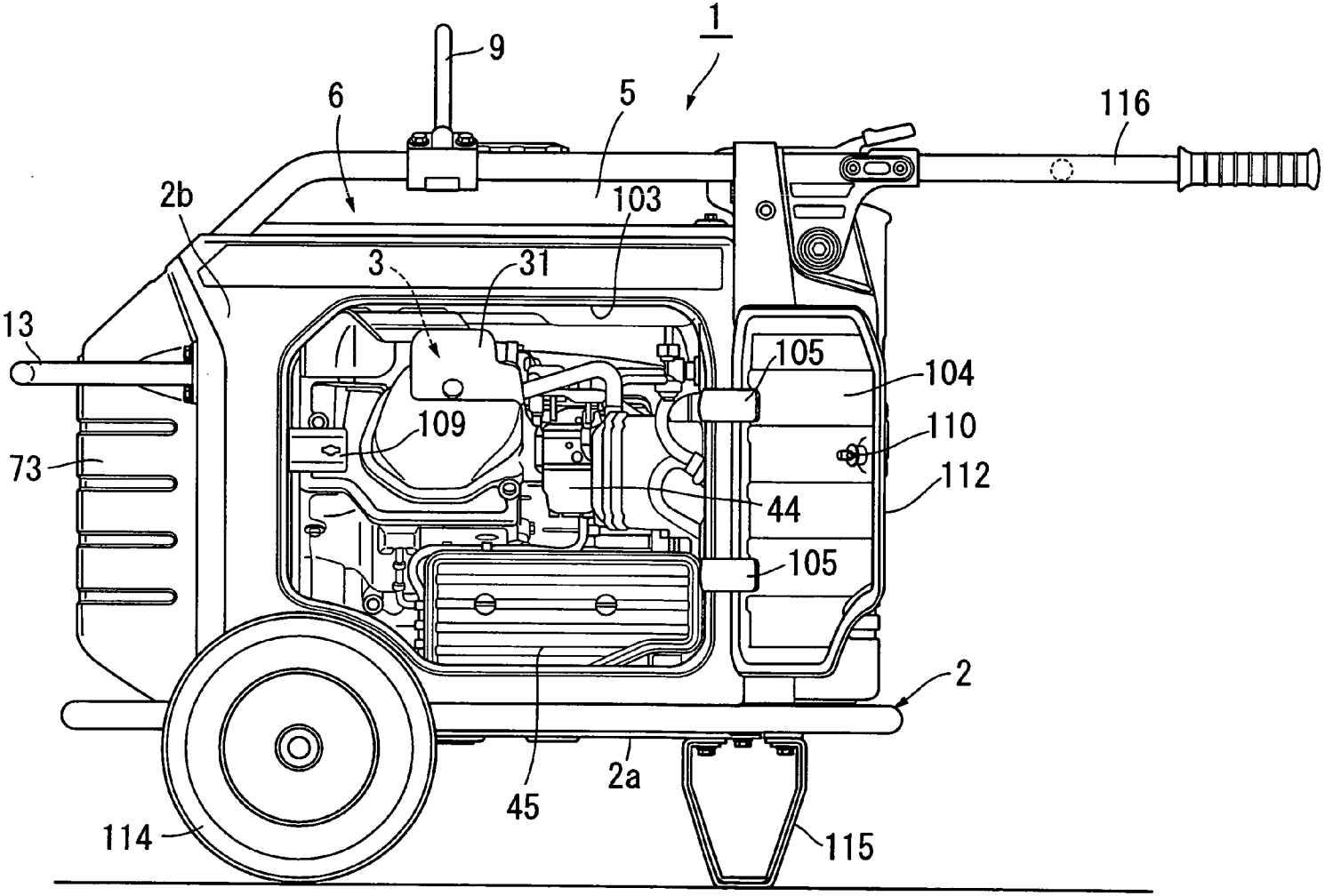
FIG. 20 is a view similar to FIG. 1, but showing an opened state of a maintenance window in a sidewall plate.

Referring to FIGS. 1, 19 and 20, a large maintenance window 103 for maintenance of the engine 3 and the other devices is provided by punching in each of the left and right sidewall plates 2*b*, 2*b*. A lid 104 for opening and closing the maintenance window 103 is formed by a blank material punched out during the formation of the maintenance window 103. Therefore, the lid 104 is smaller than the maintenance window 103.

The lid 104 is connected through a hinge 105 to the sidewall plate 2*b* at one end in the forward/rearward direction. The hinge 105 includes a first hinge arm 106 secured to the inner surface of the sidewall plate 2*b*, a second hinge arm 107 secured to an inner surface of the lid 104, and a hinge pin 108 which rotatably connects the hinge arms 106 and 107 to each other. A stopper plate 109 is secured to an inner wall of the sidewall plate 2*b* and protrudes toward the maintenance window 103 to define a closed position of the lid 104. A locking mechanism 110 is provided on the lid 104 and engages the stopper plate 109 to lock the lid 104 in a closed state.

An inward-facing collar 111 is formed by burring an inner peripheral edge of the maintenance window 103 at each of the sidewall plates 2*b*. The inward-facing collar 111 reinforces the inner peripheral edge portion of the maintenance window 103 without forming a protrusion that faces outward of the sidewall plate 2*b*. With the formation of the inward-facing collar 111, the lid 104 is smaller than the maintenance window. However, a seal member 112 is mounted around the lid 104 so that the lid 104 can reliably close the maintenance window 103.

More specifically, the seal member 112 is integrally provided with an outer seal lip 112*b* protruding toward the outer periphery of the lid 104 and an inner seal lip 96*c* positioned inside the lid 104 with respect to the outer seal lip 112*b*. Thus, when the lid 104 is closed, the outer seal lip 112*b* is brought into close contact with the outer side face of the sidewall plate 2*b*, while the inner seal lip 96*c* is brought into close contact with an inner peripheral surface of the inward-facing collar 111. A cushion projection 112*c* is integrally formed on the seal member 112 and protrudes toward the lid 104. The cushion projection 112*c* is brought into resilient abutment against the stopper plate 109, thereby defining the closed position of the lid 104.

Referring again to FIGS. 1 to 3, a pair of left and right wheels 114, 114 are shaft-supported on the frame bottom portion 2*a* of the frame 2 on the rear side, i.e., on the side of the muffler box 68, and a pair of left and right grounding legs 115, 115 are fixedly mounted on the frame bottom portion 2*a* on the front side, i.e., on the side of the intake box 34.

A pair of left and right transport handlebars 116, 116 are mounted to the front end of the frame 2. The handlebars 116, 116 are designed for turning between a use position where their grips are horizontal and a stored position where the grips are turned downwards.

The operation of this embodiment will be described below.

Upon operation of the engine 3, the generator 4 is driven by the rotating crankshaft 17 to perform power generation. The output of the generator 4 can be drawn out of a plug socket on the operating panel 53*a* after being controlled by the inverter 55 and the control unit 53.

The cooling fan 26 rotatably driven by the crankshaft 17 draws in external air as cooling air through the air-intake louver 38 into the intake box 34, and forces the air into the cooling-air passage 32 within the duct member 31. The cooling air, having passed through the cooling-air passage 32, flows through the ventilation bores 68 and 68' in the ventilation restricting plate 66 into the muffler box 73, and is then discharged to the outside from an exhaust room. The cooling air flow cools the control unit 53 and the inverter 55 within the intake box 34, the engine 3 and the generator 4 within the duct member 31, and the exhaust muffler 74 within the muffler box 68.

In the above-described process, the cooling-air passage 32 is pressurized to a pressure higher than the atmosphere due to the air forced therein by the cooling fan 26. Thus, as described above, a portion of the cooling air is leaked from the cooling-air passage 32 to the sound-insulating housing 6 through the through-bore 90 through which the intake pipe 43 passes and flows outside through the large number of ventilation bores 89 in the bottom plate 8 while increasing the pressure within the sound-insulating housing 6.

With the above-described structural arrangement, the ventilation is performed within the sound-insulating housing 6, wherein an increase in temperature is prevented within the sound-insulating housing 6, and dust, or the like, is prevented from entering the sound-insulating housing 6 through the through-bore 90. Further, a sufficient amount of the cooling air leaked through the through-bore 90 is directed to the carburetor 44, thereby preventing the carburetor 44 from overheating or from freezing due to overcooling when in a cold environment.

Moreover, because the engine 3 and the generator 4 are doubly surrounded by the duct member 31 and the sound-insulating housing 6, the operational noise of the engine 3 and the generator 4 is effectively insulated. Particularly, the intake box 34 and the muffler box 73 are connected to opposite ends of the sound-insulating housing 6 surrounding the duct member 31 so that the intake box 34, muffler box 73, and housing 6 define a silencing expansion chamber accommodating the duct member 31, wherein the sound emitted from the duct member 31 is effectively absorbed to impart a high silencing performance to the engine-driven generator system 1.

In this case, the sound-insulating housing 6 comprises the left and right sidewall plates 2*b*, 2*b* of the frame 2, the bottom plate 8 mounted to the lower portion of the frame 2, and the fuel tank 5 supported on the tank-supporting portion 92 at the upper portion of the frame 2. The large capacity fuel tank 5 also serves as a ceiling for the sound-insulating housing 6. Therefore, the structure of the sound-insulating housing 6 is simplified, and an excellent sound insulating effect is obtained by absorbing the sound emitted from the duct member 31.

Further, the endless seal member 96 is mounted onto the mounting flange 5*a* supported by the tank-supporting portion 92. The seal member 96 integrally includes the inner seal lip 96*c*, whose outer peripheral surface is in close contact with the fuel tank 5, the first and second outer seal lips 96*d* and 96*e* which are in close contact with the upper surface of the tank-supporting portion 92, and the third outer seal lip 96*f* which is in close contact with the rear surface of the intake box 34. Therefore, it is possible not only to effectively prevent noise from leaking from the periphery of the fuel tank 5, but also to reliably prevent rainwater, dust, and the like, from entering the sound-insulating housing 6 from the periphery of the fuel tank 5.

Particularly, in the above-described structural arrangement, the first and second outer seal lips 96*d* and 96*e* are doubly disposed on the inside and outside so as to come into close contact with the tank-supporting portion 92, thus further reliably preventing rainwater, dust, and the like, from entering into the sound-insulating housing 6. Further, the inner seal lip 96*c* is provided with a slope ascending toward the fuel tank 5, while the second outer seal lips 96*e* are provided with slopes descending outward. As a result, rainwater falls onto the fuel tank 5 and is allowed to smoothly flow down along the outer surfaces of the inner seal lip 96*c* and the second outer seal lips 96*e*, wherein the rainwater is effectively prevented from entering into the sound-insulating housing 6.

Even if the rainwater on the fuel tank 5 passes the inner seal lip 96*c* to reach the upper surface of the mounting flange 5*a*, the rainwater is guided by the downward-facing collar 95 at the outer peripheral end of the mounting flange 5*a* and falls downward. Because the lower end of the downward-facing collar 95 faces the drain holes 118 provided in the seal member 96, the rainwater flows through the drain holes 118 to the outside of the first outer seal lip 96*d*. Therefore, the rainwater is prevented by the first outer seal lip 96*d* from flowing inwardly of the tank-supporting portion 92.

Further, when a high-pressure water, such as cleaning water, is blown from the outside against the seal member 96, even if the water passes through the second outer seal lips 96*e*, the water is blocked by the first outer seal lip 96*d* and the seat portion 96*b*. Furthermore, even if the water passes through the first outer seal lip 96*d* and the seat portion 96*b*, the water penetration is attenuated to a mere oozing when reaching the gap 119 existing between the seat portion 96*b* and the upward-facing collar 102 at the inner peripheral end of the tank-supporting portion 92. Therefore, the water cannot pass over the upward-facing collar 102. With the above-described structural arrangement, high-pressure water is reliably prevented from entering the tank-supporting portion 92. The upward-facing collar 102 also contributes to the reinforcement of the tank-supporting portion 92.

Because the upstream end of the duct member 31, i.e., the recoil starter cover 31*a* having the ventilation bore, is disposed in the vicinity of the rear face of the inverter 55 within the intake box 34, the air around the inverter 55 is effectively drawn into the duct member 31, thereby effectively cooling the inverter 55, which is liable to be heated to a relatively high temperature. Because the control unit 53 and the inverter 55 are disposed between the first connection port 39 and the air-intake louver 38, the control unit 53 and the inverter 55 serve as sound-insulating partitions between the first connection port 39 and the air-intake louver 38, thereby preventing the leakage of the noise to the outside, which improves and improving the noise silencing effect in the intake box 34.

In addition, during the intake stroke of the engine 3, the air in the intake box 34 is drawn through the air cleaner 45 and the carburetor 44 into the engine 3. As such, the intake noise of the engine 3 is also effectively silenced by the intake box 34. In particular, the battery 61 within the intake box 34 serves as a sound-insulating partition between the second connection port 40 and the air-intake louver 38 to prevent the leakage of the intake noise to the outside, thereby further improving the noise silencing effect in the intake box 34.

On the other hand, because the air guide plate 71, suspended from the seal tube 67 to cover the front surface of the upper portion of the exhaust muffler 70, opposes the upper large ventilation bore 68 in the ventilation restricting plate 66 within the sound-insulating housing 6, the cooling air flowing out of the ventilation bore 68 is guided by the air guide plate 71 to a space below the exhaust muffler 70. As a result, the cooling air flows around the lower side of the exhaust muffler 70, ascends along the rear face of the exhaust muffler 70 while cooling the exhaust muffler 70, and is then discharged through the air-discharge louver 79 to the outside.

When the operation of the engine 3 is stopped, the forced cooling air flow is also stopped due to the stoppage of the rotation of the cooling fan 26.

However, the temperature within the muffler box 73 increases due to the residual heat of the exhaust muffler 70, and thus, the convection of the air is generated within the muffler box 73, but the ascending of the air flow is suppressed because the front face of the exhaust muffler 70 is covered by the air guide plate 71. On the other hand, an ascending air flow toward the air-discharge louver 79 is generated on the side of the rear face of the exhaust muffler 70 close to the air-discharge louver 79 and attracts the air on the side of the air guide plate 71. Therefore, the air in the cooling-air passage 32 also passes through the ventilation bores 68 and 68' and flows to the side of the rear face of the muffler 70 to become a rising flow, while being guided by the air guide plate 71 to a space below the exhaust muffler 70. The above-described continuous process effectively facilitates the natural cooling of the engine 3 and the exhaust muffler 70 even after operation of the engine 3 has stopped.

Further, the exhaust muffler 70 and the air guide plate 71 cooperatively serve as the sound-insulating walls which isolate the cooling-air passage 32 in the duct member 31 and the air-discharge louver 79 of the muffler box 73 from each other, thereby effectively preventing the operational noise of the engine 3 and the other components from leaking from the air-discharge louver 79. The above-described arrangement contributes to an improvement in the silencing performance of the engine-driven generator system 1.

During operation of the engine 3, the vibration of the engine 3 is absorbed by the resilient deformation of the resilient members 11, 11 interposed between the engine 3 and the frame 2, thereby suppressing the transmission of the vibration to the frame 2. The duct member 31 and the air cleaner 45 are vibrated together with the engine 3 because they are fixed to the engine 3, and the relative displacement due to the vibration of the engine 3 is generated between the duct member 31 and the intake box 34 and between the air cleaner 45 and the intake box 34 during operation of the engine 3 and the generator 4. However, because the first and second connection ports 39 and 40 in the intake box 34 are connected to the duct member 31 and the air cleaner 45 through the highly flexible first and second seal members 41 and 42, the flexure of the first and second seal members 41 and 42 absorbs the relative displacement between the duct member 31 and the intake box 34 and between the air cleaner 45 and the intake box 34, thereby effectively providing the cooling air flow from the intake box 34 to the duct member 31 without leakage.

The maintenance windows 103, 103 opened and closed by the lids 104, 104 are provided in the left and right sidewalls of the sound-insulating housing 6, i.e., in the sidewall plates 2*b*, 2*b* of the frame 2. Thus, if the lids 104 are opened, maintenance can easily be carried out through the maintenance windows 103 for the carburetor 44, the air cleaner 45 and the other components disposed within the sound-insulating housing 6 outside the duct member 31.

Each lid 104 is formed from a blank material punched out during the formation of the maintenance window 103 by punching the sidewall plate 2*b* corresponding to the lid 104, thus providing a good yield of the material to reduce the cost. Further, the lid 104 is smaller than the maintenance window 103, because the inward-facing collar 111 is formed at the inner peripheral edge of the maintenance window 103 in order to reinforce the inner peripheral edge. However, the seal member 112 is mounted around each lid 104 and is integrally provided with the outer seal lip 112*b* and the inner seal lip 112*a* adapted to respectively come into close contact with the outer side face of the sidewall plate 2*b* and the inner peripheral surface of the inward-facing collar 111 which form an angle when the lid 104 is closed. Therefore, the maintenance windows 103 can reliably be closed by the lid 104 to prevent rainwater, dust, and the like, from entering and to prevent leakage of the operational noise of the engine 3.

In the closed position of the lid 104, the cushion projection 112*c* of the seal member 112 resiliently abuts against the stopper plate 109 of the sidewall plate 2*b* to absorb the shock of the lid 104 being closed without use of a special cushion member, thereby contributing to simplification of the structure. The stopper plate 109 also serves as a locking member of the locking mechanism 110 provided in the lid 104 which also contributes to the simplification of the structure.

The present invention is not limited to the above-described embodiment, and various modifications in design may be made without departing from the scope of the invention.

For example, the air cleaner 45 may be fixedly supported on the frame 2, as in the case of the intake box 34, so that the relative displacement between the carburetor 44 and the air cleaner 45, generated with the vibration of the engine 3, is absorbed by the flexure of the resilient communication tube 46 which provides communication between the carburetor 44 and the air cleaner 45. In this case, the air inlet pipe 47*a* of the air cleaner 45 can integrally be connected to the intake box 34.

What is claimed is:

1. An engine-driven work machine connected to and driven by an engine, comprising:

a duct member disposed around outer peripheries of the engine and the work machine to define a continuous cooling-air passage between the duct member and the outer peripheries;

a cooling fan disposed in the cooling-air passage and which generates a flow of cool air from one end of the cooling-air passage to the other end during operation of the engine, an exhaust muffler of the engine disposed in the vicinity of the other end of the cooling-air passage, wherein the exhaust muffler is cooled by the cooling air flowing out of the cooling-air passage; and an air guide plate connected to the duct member is suspended from an upper portion of the duct member and covers an upper portion of one side face of the exhaust muffler which is opposite the cooling-air passage, wherein the air guide plate guides the cooling air flowing out of the cooling-air passage downward along the one side face of the exhaust muffler.

2. The work machine according to claim 1, further comprising a muffler box connected to the duct member and which accommodates the exhaust muffler therein; and an air-discharge port provided in an upper portion of the muffler box which discharges the cooling air guided downward by the air guide plate to flow along the one side face of the exhaust muffler and then flow around to the other side face opposite the one side face of the exhaust muffler.

3. The work machine according to claim 1, wherein the exhaust muffler is disposed so a lengthwise side face opposes an outlet of the cooling-air passage.

4. The work machine according to claim 2, wherein the exhaust muffler is disposed so a lengthwise side face opposes an outlet of the cooling-air passage.

* * * * *